US009557704B2

(12) United States Patent
Sato et al.

(10) Patent No.: US 9,557,704 B2
(45) Date of Patent: Jan. 31, 2017

(54) IMAGE FORMING APPARATUS HAVING WASTE TONER CONTAINER COMMONLY USED FOR PHOTOSENSITIVE DRUMS AND TRANSFER BELT

(71) Applicant: Brother Kogyo Kabushiki Kaisha, Nagoya-shi, Aichi-ken (JP)

(72) Inventors: Shougo Sato, Seto (JP); Atsushi Fukui, Toyota (JP); Isao Fukuchi, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/982,995

(22) Filed: Dec. 29, 2015

(65) Prior Publication Data

US 2016/0132017 A1 May 12, 2016

Related U.S. Application Data

(63) Continuation of application No. 14/553,456, filed on Nov. 25, 2014, now Pat. No. 9,239,563.

(30) Foreign Application Priority Data

Nov. 26, 2013 (JP) ..... 2013-243774

(51) Int. Cl.
*G03G 15/00* (2006.01)
*G03G 21/10* (2006.01)
(Continued)

(52) U.S. Cl.
CPC ..... *G03G 21/10* (2013.01); *G03G 15/0178* (2013.01); *G03G 15/166* (2013.01);
(Continued)

(58) Field of Classification Search
CPC .... G03G 15/166; G03G 21/10; G03G 21/105; G03G 21/169; G03G 2215/1647; G03G 2215/1661; G03G 2221/1869; G03G 2221/183; G03G 15/0178; G03G 21/0005; G03G 2221/1684
(Continued)

(56) References Cited

U.S. PATENT DOCUMENTS 7,391,990 B2 6/2008 Fujii et al.
8,116,662 B2 2/2012 Ohta
(Continued)

FOREIGN PATENT DOCUMENTS

JP 2010-008472 A 1/2010
JP 2010-102285 A 5/2010
(Continued)

OTHER PUBLICATIONS

Jan. 29, 2016—(US) Notice of Allowance—U.S. Appl. No. 14/954,624.
(Continued)

*Primary Examiner* — Sophia S Chen
(74) *Attorney, Agent, or Firm* — Banner & Witcoff, Ltd.

(57) ABSTRACT

An image forming apparatus includes a main frame, a plurality of process cartridges, a cartridge-supporting body, a belt, a belt cleaning unit, a waste toner cartridge, and a collective conveying unit. Each drum-cleaning unit collects waste toner on a corresponding photosensitive drum. The cartridge-supporting body supports the process cartridges and is movable between an internal position inside the main frame and an external position outside of the main frame. The belt cleaning unit collects waste toner on the belt. The waste toner cartridge accommodates both waste toner collected from the photosensitive drums by the drum-cleaning units and waste toner collected from the belt by the belt cleaning unit. The collective conveying unit aggregates both waste toner collected from the photosensitive drums by the drum-cleaning units and waste toner collected from the belt by the belt cleaning unit and conveys the aggregated waste toner to the waste toner cartridge.

20 Claims, 11 Drawing Sheets

(51) Int. Cl.

| | |
|---|---|
| ***G03G 21/16*** | (2006.01) |
| ***G03G 15/01*** | (2006.01) |
| ***G03G 21/00*** | (2006.01) |
| ***G03G 15/16*** | (2006.01) |

(52) U.S. Cl.
CPC ..... *G03G 21/0005* (2013.01); *G03G 21/105* (2013.01); *G03G 21/169* (2013.01); *G03G 2215/1647* (2013.01); *G03G 2215/1661* (2013.01); *G03G 2221/1684* (2013.01); *G03G 2221/183* (2013.01); *G03G 2221/1869* (2013.01)

(58) Field of Classification Search
USPC ..... 399/101, 110, 358
See application file for complete search history.

(56) References Cited

U.S. PATENT DOCUMENTS

| | | | |
|---|---|---|---|
| 8,346,151 | B2 | 1/2013 | Akaike et al. |
| 8,548,354 | B2 | 10/2013 | Kikuchi |
| 8,577,259 | B2 | 11/2013 | Sato |
| 2005/0058475 | A1 | 3/2005 | Tsurusaki |
| 2006/0104663 | A1 | 5/2006 | Kitozaki |
| 2010/0074646 | A1 | 3/2010 | Miyahara et al. |
| 2010/0080615 | A1 | 4/2010 | Kikuchi |
| 2010/0119271 | A1 | 5/2010 | Akaike |
| 2010/0209157 | A1 | 8/2010 | Sato et al. |
| 2010/0239340 | A1 | 9/2010 | Akaike et al. |
| 2012/0027459 | A1 | 2/2012 | Sato |
| 2012/0315063 | A1 | 12/2012 | Kikuchi |
| 2013/0223873 | A1 | 8/2013 | Manabe |
| 2014/0037322 | A1 | 2/2014 | Sato |
| 2014/0044465 | A1 | 2/2014 | Mekada |
| 2014/0334842 | A1 | 11/2014 | Fukuchi et al. |

FOREIGN PATENT DOCUMENTS

| | | |
|---|---|---|
| JP | 2010-224004 A | 10/2010 |
| JP | 2012-032610 A | 2/2012 |

OTHER PUBLICATIONS

Nov. 25, 2014—(US) Co-pending U.S. Appl. No. 14/553,381.
Nov. 25, 2014—(US) Co-pending U.S. Appl. No. 14/553,134.
May 19, 2015—(US) Ex Parte Quayle Office Action—U.S. Appl. No. 14/553,134.
May 20, 2015—(US) Non-Final Office Action—U.S. Appl. No. 14/553,381.
Sep. 11, 2015—(US) Notice of Allowance—U.S. Appl. No. 14/553,381.
May 27, 2016—(US) Non-Final Office Action—U.S. Appl. No. 15/143,788.
Aug. 12, 2016—(US) Notice of Allowance—U.S. Appl No. 14/979,745.
Nov. 8, 2016—(JP) Office Action—App 2013-243774, Eng Tran.

IMAGE FORMING APPARATUS HAVING WASTE TONER CONTAINER COMMONLY USED FOR PHOTOSENSITIVE DRUMS AND TRANSFER BELT

CROSS REFERENCE TO RELATED APPLICATION

This application is a continuation of prior U.S. application Ser. No. 14/553,456, filed Nov. 25, 2014, which claims priority from Japanese Patent Application No. 2013-243774, filed Nov. 26, 2013. The entire contents of the priority applications are incorporated herein by reference.

TECHNICAL FIELD

The present invention relates to an image forming apparatus, particularly, an electro-photographic type image forming apparatus.

BACKGROUND

A tandem type image forming apparatus as an electro-photographic type image forming apparatus is known in which are provided a plurality of photosensitive drums, a transfer belt positioned in confrontation therewith, a plurality of process cartridges for a plurality of colors such as for example, yellow, magenta, cyan and black, and a drawer unit configured to support the process cartridges.

In such a tandem type image forming apparatus, each process cartridge is provided with a drum-cleaning unit configured to remove waste toner remaining on each photosensitive drum associated with each process cartridge, and a waste toner container configured to accumulate the waste toner removed by the drum-cleaning unit.

Further, Japanese patent application publication No. 2010-102285 discloses such a tandem type image forming apparatus in which a belt cleaning unit and a waste toner container are provided in an internal space of a frame of the device. The belt cleaning unit is positioned below the transfer belt and is configured to remove waste toner remaining on the transfer belt. The waste toner container is configured to accumulate waste toner removed by the belt cleaning unit.

SUMMARY

The above-disclosed image forming apparatus is bulky because each process cartridge is provided with the waste toner container for accumulating waste toner removed from the photosensitive drum, and the frame is provided with the waste toner container for accumulating waste toner removed from the transfer belt.

In view of the foregoing, it is an object of the present invention to provide a compact image forming apparatus yet capable of performing waste toner collection from a plurality of photosensitive drums and a belt.

In order to attain the above and other objects, the invention provides an image forming apparatus that may include a main frame, a plurality of process cartridges, a cartridge-supporting body, a belt, a belt cleaning unit, a waste toner cartridge, and a collective conveying unit. The plurality of process cartridges may include a plurality of photosensitive drums and a plurality of drum-cleaning units. The plurality of process cartridges may be provided in one-to-one correspondence with the plurality of photosensitive drums. The plurality of photosensitive drums may be provided in one-to-one correspondence with the plurality of drum-cleaning units. Each of the plurality of drum-cleaning units may be configured to collect waste toner on a corresponding photosensitive drum. The cartridge-supporting body may be configured to support the plurality of process cartridges and be movable between an internal position inside the main frame and an external position outside of the main frame. The belt may be configured to confront the plurality of process cartridges when the cartridge-supporting body supporting the plurality of process cartridges is in the internal position. The belt cleaning unit may be configured to collect waste toner on the belt. The waste toner cartridge may be configured to accommodate both waste toner collected from the plurality of photosensitive drums by the plurality of drum-cleaning units and waste toner collected from the belt by the belt cleaning unit. The collective conveying unit may be provided in the cartridge-supporting body and may be configured to aggregate both waste toner collected from the plurality of photosensitive drums by the plurality of drum-cleaning units and waste toner collected from the belt by the belt cleaning unit. The collective conveying unit may be configured to convey collectively the aggregated waste toner to the waste toner cartridge.

According to another aspect, the present invention provides an image forming apparatus that may include a main frame, a plurality of cartridges, a drawer unit, a belt, a belt cleaning unit, a waste toner cartridge, and a collective conveying unit. Each of the plurality of cartridges may be configured to accommodate toner therein. The drawer unit may be configured to support the plurality of cartridges and be movable between an internal position inside the main frame and an external position outside of the main frame. The drawer unit may include a plurality of photosensitive drums, and a plurality of drum-cleaning units. The plurality of drum-cleaning units may be provided in one-to-one correspondence with the plurality of photosensitive drums. Each of the plurality of drum-cleaning units may be configured to collect waste toner on a corresponding photosensitive drum. The belt may be configured to confront the plurality of photosensitive drums when the drawer unit supporting the plurality of cartridges is in the internal position. The belt cleaning unit may be configured to collect waste toner on the belt. The waste toner cartridge may be configured to accommodate both waste toner collected from the plurality of photosensitive drums by the plurality of drum-cleaning units and waste toner collected from the belt by the belt cleaning unit. The collective conveying unit may be provided in the drawer unit and be configured to aggregate both waste toner collected from the plurality of photosensitive drums by the plurality of drum-cleaning units and waste toner collected from the belt by the belt cleaning unit. The collective conveying unit may be configured to convey collectively the aggregated waste toner to the waste toner cartridge.

BRIEF DESCRIPTION OF THE DRAWINGS

The particular features and advantages of the invention as well as other objects will become apparent from the following description taken in connection with the accompanying drawings, in which.

DETAILED DESCRIPTION

1. Overall Structure of Printer

Figure 1:
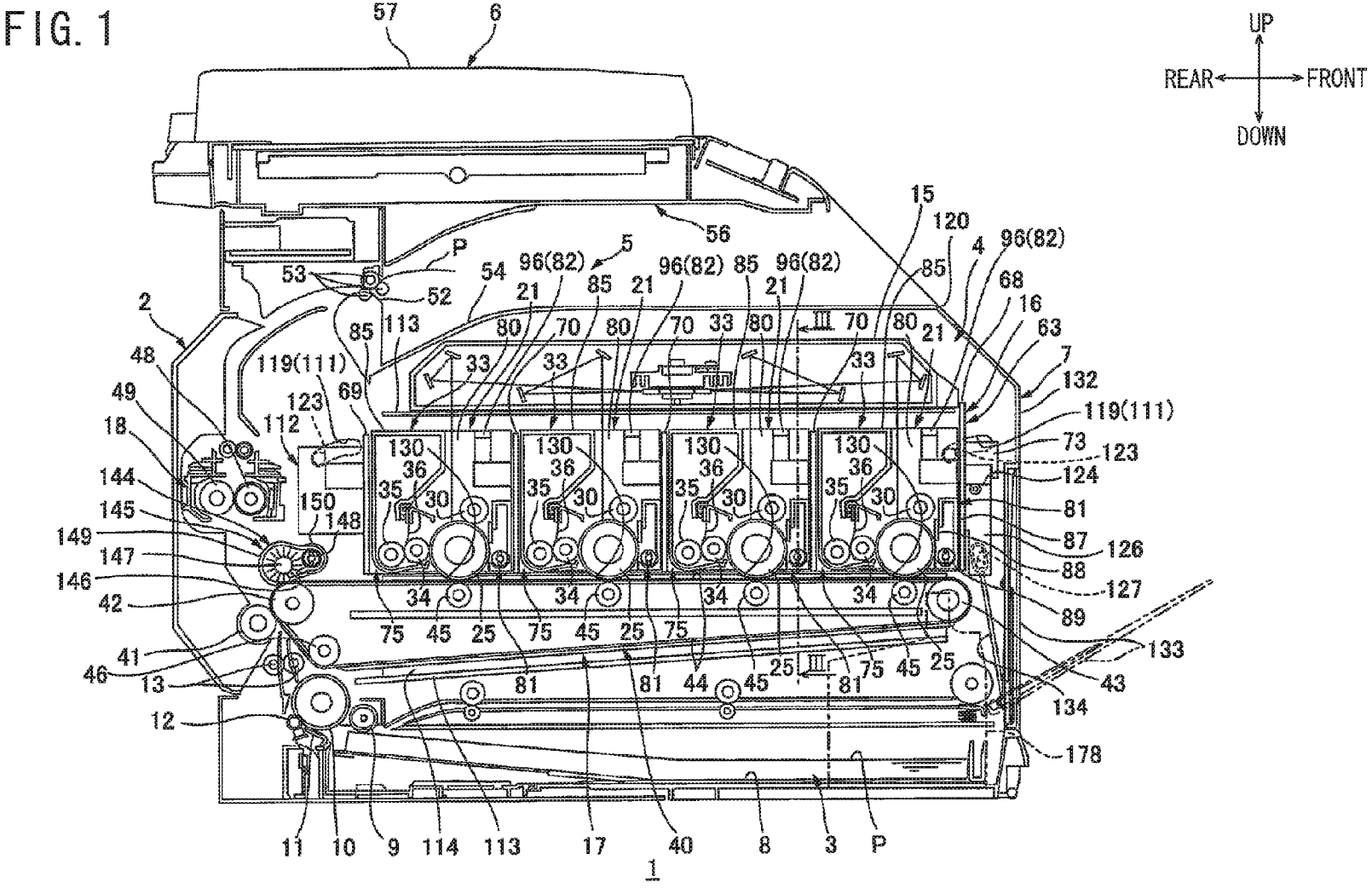
FIG. 1 is a cross-sectional view of a printer as an example of an image forming apparatus according to a first embodiment of the present invention and showing an internal contact position of a cartridge-supporting body.

As shown in FIG. 1, a printer 1 as an example of an image forming apparatus is a transverse-mounted intermediate transfer type color printer. The printer 1 includes a main casing 2 as an example of a main frame, a sheet supply unit 3 for supplying a sheet P, an image forming unit 4 for forming an image on the sheet P, and a discharge unit 5 for discharging the image formed sheet P. These units 3, 4 and 5 are provided in an internal space of the main casing 2.

The printer 1 is also provided with an image reading unit 6 positioned above the main casing 2 for reading image data of an original.

(1) Main Casing

The main casing 2 is generally box shaped and is provided with a front cover 7. The main casing 2 has a front wall, and the front cover 7 is pivotally connected to a lower portion of the front wall and is movable to a closed position shown in FIG. 1 and an open position shown in FIG. 7 in order to permit a cartridge-supporting body 16 (described later) to slidingly move into an interior and an exterior of the main casing 2.

In the following description, the terms "upward", "downward", "upper", "lower", "above", "below", "beneath", "right", "left", "front", "rear" and the like will be used assuming that the printer 1 is disposed in a horizontal orientation in which it is intended to be used. In use, the printer 1 is disposed as illustrated in FIG. 1, in which a left side and a right side in FIG. 1 are a rear side and a front side, respectively, a far side and a near side in FIG. 1 are a right side and a left side, respectively, and a top side and a bottom side in FIG. 1 are a top side and a bottom side, respectively.

(2) Sheet Supply Unit

The sheet supply unit 3 includes a sheet supply tray 8 for accommodating a stack of sheets P, a pick-up roller 9, a sheet supply roller 10, a sheet supply pad 11, a pinch roller 12, and a pair of registration rollers 13. The pick-up roller 9 is configured to deliver a sheet P on the sheet supply tray 8 to a position between the sheet supply roller 10 and the sheet supply pad 11 by the rotation of the pick-up roller 9. The sheet supply roller 10 is adapted, by its rotation, to deliver each one of the sheets P in cooperation with the pinch roller 12 to the pair of registration rollers 13 positioned higher than the sheet supply roller 10. The pair of registration rollers 13 is adapted, by their rotation, to deliver the sheet P to a position between an intermediate transfer belt 44 (described later) and a secondary transfer roller 41 (described later) at a prescribed timing.

(3) Image Forming Portion

The image forming unit 4 includes a scanning unit 15, a plurality of process cartridges 21 (four cartridges), the cartridge-supporting body 16, a transfer unit 17, and a fixing unit 18.

The scanning unit 15 is positioned at an upper internal portion of the main casing 2. The scanning unit 15 is configured to emit laser beam based on image data toward a plurality of (four) photosensitive drums 25 (described later) as indicated by a solid line, so as to expose the photosensitive drums 25 to light to thus form an electrostatic latent image on an outer peripheral surface of the photosensitive drum 25.

The process cartridge 21 includes the photosensitive drum 25, a charging roller 30 for charging the outer peripheral surface of the photosensitive drum 25, and a developing unit 33 for supplying toner to the electrostatic latent image to form a toner image corresponding thereto.

The cartridge-supporting body 16 is positioned at vertically intermediate portion within the main casing 2 and below the scanning unit 15. The cartridge-supporting body 16 is configured to support the four process cartridges 21.

The transfer unit 17 is positioned at a lower portion within the main casing 2, and below the cartridge-supporting body 16 and above the sheet supply unit 3. The transfer unit 17 includes a belt unit 40 and the secondary transfer roller 41.

The belt unit 40 extends in frontward/rearward direction and is positioned below the four photosensitive drums 25. The belt unit 40 includes an intermediate transfer belt 44 as an example of a belt, a plurality of (four) primary transfer rollers 45 configured to sequentially transfer each toner image on each photosensitive drum 25 onto the intermediate transfer belt 44, a drive roller 42, a follow roller 43, and a tension roller 46. The intermediate transfer belt 44 is mounted over the drive roller 42 and the follow roller 43.

The secondary transfer roller 41 is positioned rearward of the drive roller 42 and nips the intermediate transfer belt 44 in cooperation with the drive roller 42. The secondary transfer roller 41 is configured to transfer a color image formed on the intermediate transfer belt 44 onto a sheet P supplied from the sheet supply unit 3. That is, secondary image transfer is performed by the secondary transfer roller 41.

The fixing unit 18 is positioned diagonally upward of the secondary transfer roller 41, and includes a heat roller 48 and a pressure roller 49 positioned rearward of the heat roller 48 and in pressure contact therewith. The fixing unit 18 is configured to thermally fix a toner image to the sheet P when the sheet P is moved past the heat roller 48 and the pressure roller 49.

(4) Sheet Discharge Portion

The sheet discharge unit 5 extends upward from a rear upper portion of the main casing 2, and has a discharge opening 52 and three discharge rollers 53 for discharging a sheet P fed from the fixing unit 18 onto a discharge tray 54.

The discharge opening 52 is positioned at a front end of the sheet discharge unit 5 and provides communication between the interior and exterior of the main casing 2. The three discharge rollers 53 are positioned to nip and guide the sheet P passing through the discharge opening 52. The discharge tray 54 is comparted at an upper surface of the main casing 2 and is positioned frontward of the sheet discharge unit 5.

(5) Image Reading Portion

The image reading unit 6 is positioned above the main casing 2 so as to cover the sheet discharge unit 5. The image reading unit 6 is generally rectangular shaped in planar view having a frontward/rearward length and leftward/rightward length approximately equal to those of the main casing 2. The image reading unit 6 includes an original stand 56 for mounting thereon an original, and a presser cover 57 pivotally movably supported to the original stand 56.

The image forming unit 4 is configured to form on a sheet P an image on the basis of image data read by the image reading unit 6.

2. Detailed Description of the Process Cartridges

Figure 3:
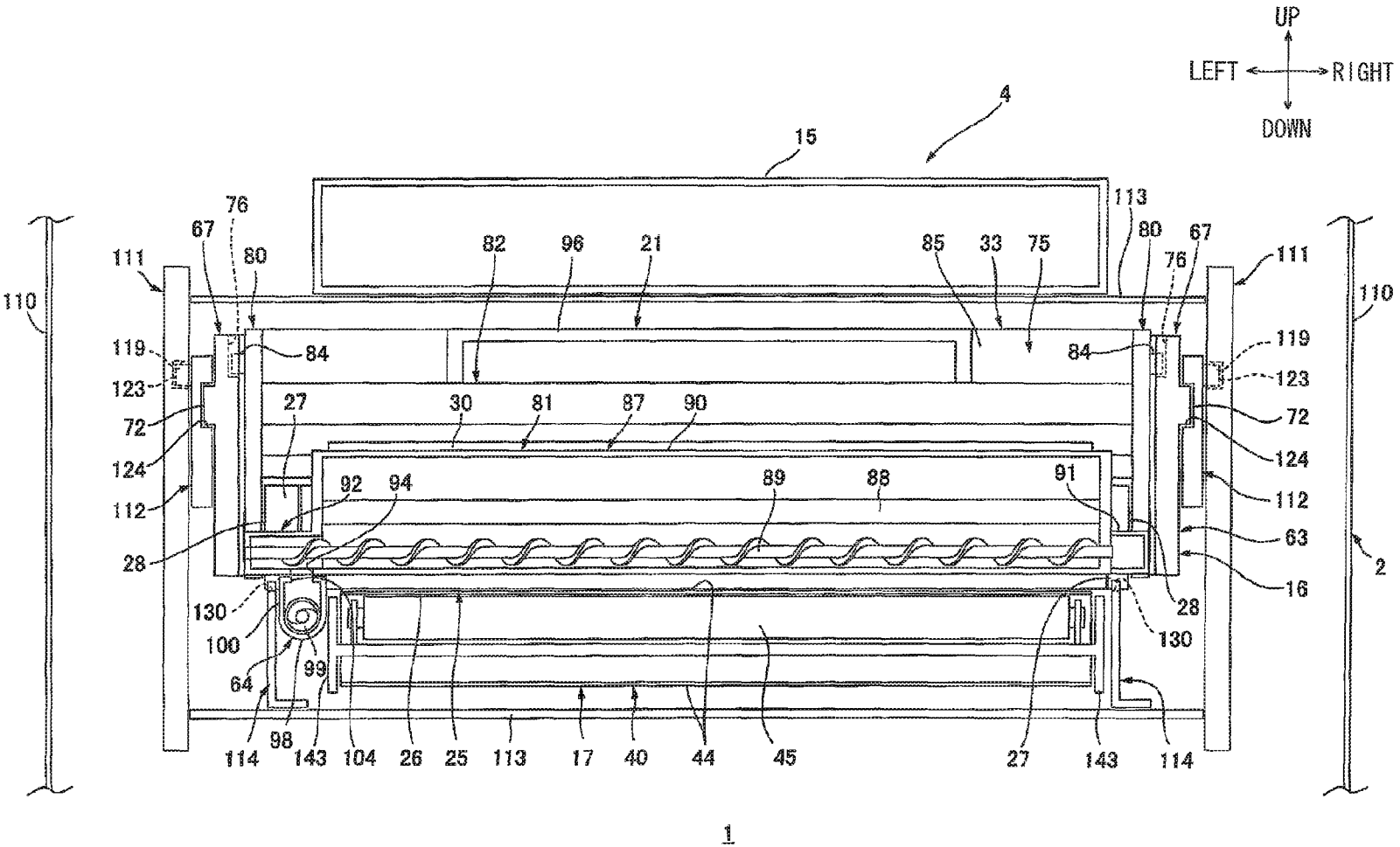
FIG. 3 is a cross-sectional view taken along a line III-III in FIG. 1 showing an assembled state of a process cartridge with respect to the cartridge supporting body.

As shown in FIGS. 1 and 3, in addition to the photosensitive drum 25, charging roller 30, and developing unit 33 described above, each process cartridge 21 includes a pair of side cartridge walls 80, a drum-cleaning unit 81 for collecting waste toner from the outer peripheral surface of the corresponding photosensitive drum 25, and a cartridge coupling rod 82.

(1) Side Cartridge Walls

Figure 2:
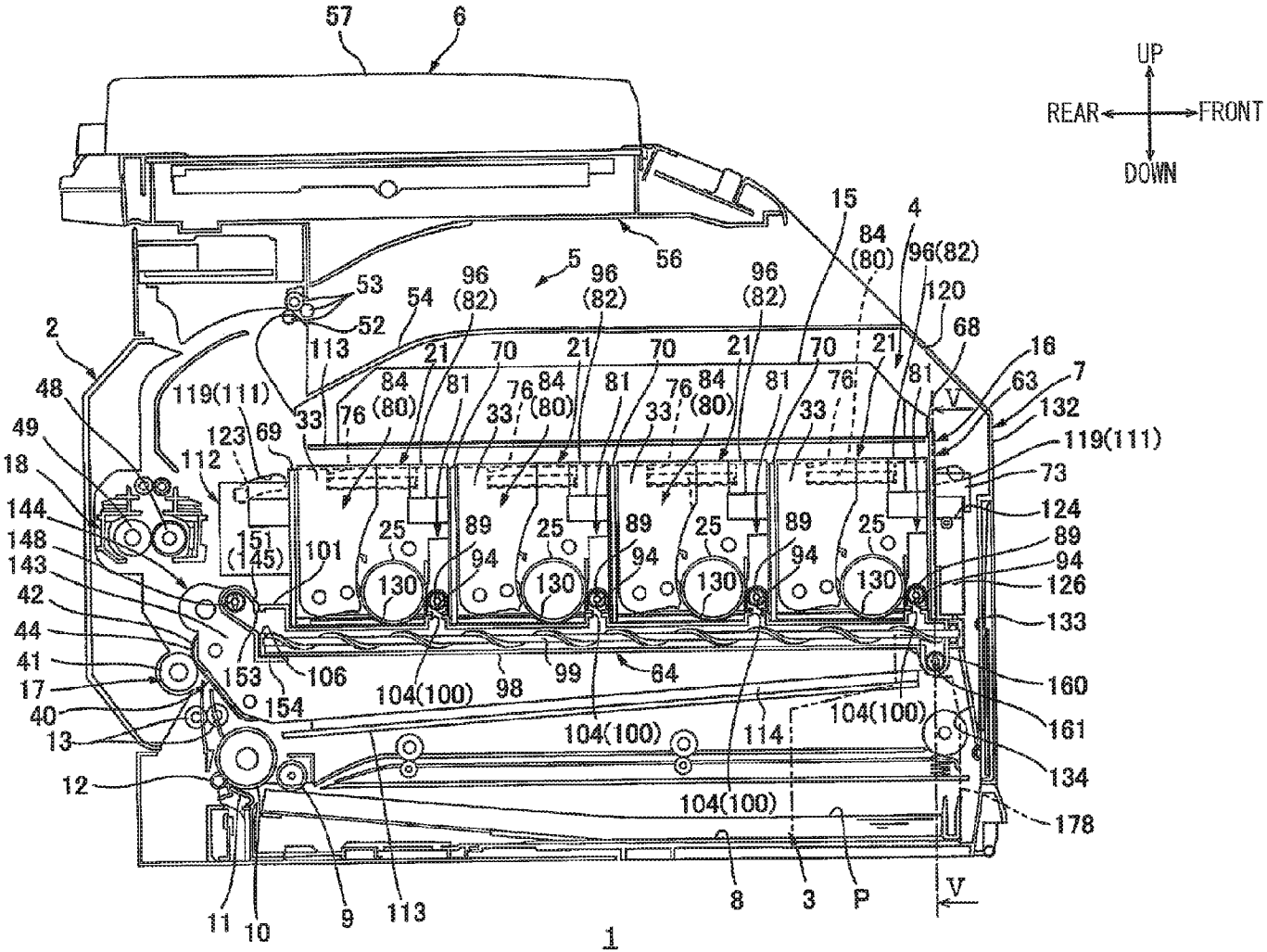
FIG. 2 is a cross-sectional view of the printer taken along a collective conveying unit when the internal contact position of the cartridge supporting body.

The side cartridge walls 80 are arranged so as to be separated in the left-right direction. The side cartridge walls 80 are plate-like and have a general rectangular shape in a side view that is elongated both vertically and in the front-rear direction. As shown in FIGS. 2 and 3, each side cartridge wall 80 has an engaging protrusion 84 for engaging in a corresponding receiving groove 76 of a support-body frame 63 described later.

The engaging protrusion 84 has a ridge-like shape that is elongated in the front-rear direction and protrudes outward in the left-right direction from the outer left-right surface of the corresponding side cartridge wall 80 in the upper portion thereof. The front-rear dimension of the engaging protrusion 84 is slightly smaller than the front-rear dimension of a receiving groove 76 described later.

(2) Photosensitive Drums

Figure 4:
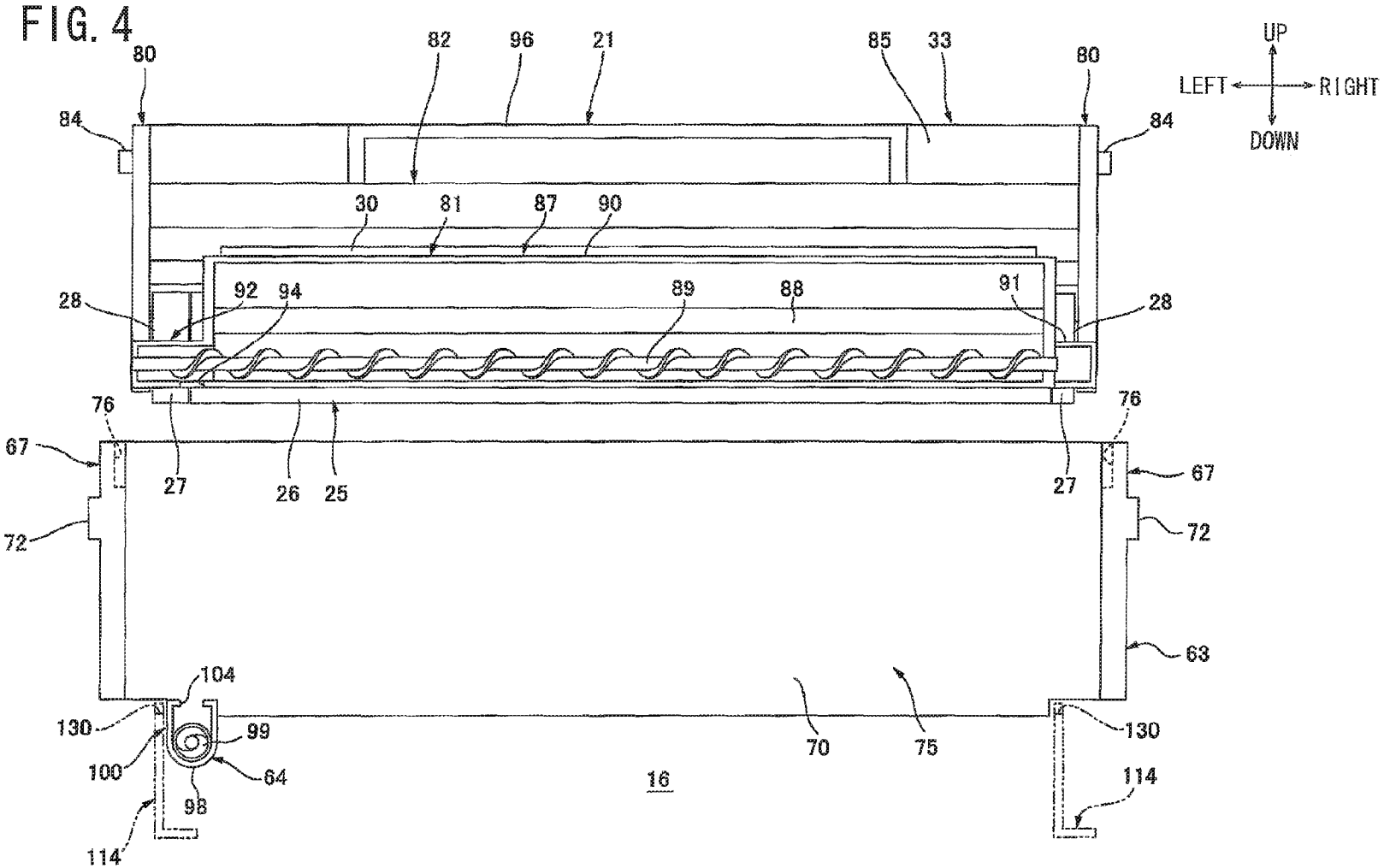
FIG. 4 is a cross-sectional view taken along the line III-III in FIG. 1 showing a disassembled state of the process cartridge with respect to the cartridge supporting body.

The photosensitive drum 25 is disposed in the bottom of the corresponding process cartridge 21 and is positioned in the approximate front-rear center region thereof. As shown in FIGS. 3 and 4, the photosensitive drum 25 includes a drum body 26, a pair of flanges 27, and a drum shaft 28.

The drum body 26 has a general cylindrical shape and is oriented with its axis aligned in the left-right direction. A photosensitive layer is formed over the outer peripheral surface of the drum body 26.

The flanges 27 have a general cylindrical shape with radial directions extending in vertical and front rear directions. The outer diameter of the flanges 27 is approximately equivalent to the outer diameter of the drum body 26. The flanges 27 are disposed one each on the left and right ends of the drum body 26.

The drum shaft 28 has a general columnar shape that is elongated in the left-right direction. The drum shaft 28 is inserted through the drum body 26 and the flanges 27. The left and right ends of the drum shaft 28 protrude outward in corresponding left and right directions from the flanges 27.

The photosensitive drum 25 is rotatably supported in the side cartridge walls 80 with the left and right ends of the drum shaft 28 supported in corresponding side cartridge walls 80.

(3) Charging Rollers

As shown in FIG. 1, the charging roller 30 is disposed on the upper front side of the corresponding photosensitive drum 25. The charging roller 30 has a general columnar shape and is oriented with its axis in the left-right direction. The lower rear surface of the charging roller 30 contacts the upper front surface of the corresponding photosensitive drum 25. As shown in FIGS. 3 and 4, the charging roller 30 is rotatably supported in the pair of side cartridge walls 80, with the left and right ends of the charging roller 30 supported in the corresponding side cartridge wall 80.

(4) Developing Units

As shown in FIG. 1, the developing unit 33 is disposed in the rear portion of the corresponding process cartridge 21 and functions to accommodate toner therein. Each developing unit 33 includes a developing-unit frame 85, a developing roller 34 for supplying toner onto the surface of the corresponding photosensitive drum 25, a supply roller 35 for supplying toner in the developing unit 33 to the corresponding developing roller 34, and a thickness-regulating blade 36 for regulating the thickness of toner supplied onto the developing roller 34.

The developing-unit frame 85 is arranged along the entire rear portion of the process cartridge 21 in the vertical direction. The developing-unit frame 85 has a general squared columnar shape and is elongated in the left-right direction. The left and right sides of the developing-unit frame 85 are respectively connected to the left-right inner surfaces on the rear portions of the corresponding side cartridge walls 80. The front wall of the developing-unit frame 85 has an opening formed in the lower edge thereof. The opening spans the entire left-right dimension of the developing-unit frame 85 and penetrates the front wall in the front-rear direction.

The developing roller 34 has a general columnar shape and is oriented with its axis in the left-right direction. The developing roller 34 is disposed in the lower front region of the corresponding developing unit 33, such that the front and upper surfaces of the developing roller 34 are exposed on the outside of the developing unit 33. The front surface of the developing roller 34 is in contact with the rear surface of the corresponding photosensitive drum 25. The developing roller 34 is disposed in the lower front region of the developing-unit frame 85 with both left and right ends supported in the side cartridge walls 80 such that the upper and front portions of its surface are exposed through the opening in the developing-unit frame 85.

The supply roller 35 has a general columnar shape and is oriented with its axis in the left-right direction. The supply roller 35 is disposed on the rear side of the corresponding developing roller 34 such that the front surface of the supply roller 35 contacts the rear surface of the developing roller 34 with pressure. The supply roller 35 is disposed in the lower rear region of the developing-unit frame 85 with both its left and right ends supported in the side cartridge walls 80.

The thickness-regulating blade 36 is disposed on the upper rear side of the corresponding developing roller 34. In a side view, the thickness-regulating blade 36 has a general plate shape that is oriented vertically. The bottom edge of the thickness-regulating blade 36 contacts the upper rear surface of the corresponding developing roller 34. The thickness-regulating blade 36 is fixed to the upper peripheral edge surrounding the opening in the developing-unit frame 85.

(5) Drum-Cleaning Unit

As shown in FIG. 1, each drum-cleaning unit 81 includes a drum-cleaning frame 87, a drum-cleaning blade 88 as an example of a drum cleaning member, and a drum-cleaning screw 89 as an example of a conveying member. Note that FIG. 1 shows reference numerals only for those members constituting the drum-cleaning unit 81 provided for the forwardmost process cartridge 21. Reference numerals have been omitted for those members constituting drum-cleaning units 81 provided for the other three process cartridges 21 to reduce confusion in the drawing.

(5-1) Drum-Cleaning Frame

The drum-cleaning frame 87 is disposed in the lower front region of the corresponding process cartridge 21 on the front side of the photosensitive drum 25. As shown in FIGS. 3 and 4, each drum-cleaning frame 87 includes a frame body 90, a right frame protrusion 91, and a left frame protrusion 92.

The frame body 90 has a general squared cylindrical shape that is elongated in the left-right direction and closed on both left and right ends. An opening that spans the entire left-right dimension of the frame body 90 is formed in the bottom portion of the rear wall constituting the frame body 90 and penetrates the rear wall in the front-rear direction.

The right frame protrusion 91 protrudes rightward from the right surface of the frame body 90 at the bottom region thereof. The right frame protrusion 91 has a general squared cylindrical shape that is closed on the right end.

The left frame protrusion 92 protrudes leftward from the left surface of the frame body 90 at the bottom edge thereof. The left frame protrusion 92 has a general squared cylindrical shape that is closed on the left end. The right end of the left frame protrusion 92 is connected to the frame body 90 such that the interior of the left frame protrusion 92 is in communication with the frame body 90. A communication hole 94 is also formed in the frame body 90 for discharging waste toner from the drum-cleaning frame 87.

The communication hole 94 is formed in a bottom portion of the left frame protrusion 92 at the left end thereof and penetrates the left frame protrusion 92 vertically to provide communication between the interior and exterior of the left frame protrusion 92.

The drum-cleaning frame 87 is supported in the pair of side cartridge walls 80 by connecting the right frame protrusion 91 to the right side cartridge wall 80 and by connecting the left frame protrusion 92 to the left side cartridge wall 80.

(5-2) Drum-Cleaning Blade

As shown in FIG. 1, the drum-cleaning blade 88 is disposed on the rear side of the corresponding drum-cleaning frame 87. The drum-cleaning blade 88 has a plate-like shape that is elongated in the left-right direction and has substantial thickness in the front-rear direction. The upper portion of the drum-cleaning blade 88 is fixed to the rear surface of the drum-cleaning frame 87, and specifically to the upper peripheral edge defining the opening formed in the drum-cleaning frame 87. The lower portion of the drum-cleaning blade 88 confronts the upper half of the opening formed in the drum-cleaning frame 87. The bottom edge of the drum-cleaning blade 88 contacts the front surface of the drum body 26 constituting the corresponding photosensitive drum 25.

(5-3) Drum-Cleaning Screw

The drum-cleaning screw 89 is disposed in the bottom region of the corresponding drum-cleaning frame 87. As shown in FIG. 3, the drum-cleaning screw 89 is a left-handed auger screw feeder having a rotational shaft that extends in the left-right direction. The right end of the rotational shaft constituting the drum-cleaning screw 89 is rotatably supported in the right wall of the frame body 90 constituting the drum-cleaning frame 87. The left end of the rotational shaft is rotatably supported in the left wall of the left frame protrusion 92.

As will be described later in greater detail, the drum-cleaning frame 87 is a conveying tube through which waste toner scraped off the corresponding drum body 26 by the drum-cleaning blade 88 can pass.

(6) Cartridge Coupling Rods

As shown in FIGS. 1 and 4, the cartridge coupling rod 82 of each process cartridge 21 spans between the front regions of the side cartridge walls 80 at a vertical position approximately one-third the vertical dimension of the side cartridge walls 80 from the top edges thereof. The cartridge coupling rods 82 have a general rod-like shape that is elongated in the left-right direction and has a general rectangular cross section. Each cartridge coupling rod 82 has a process handle 96 that the user can grip when mounting the process cartridge 21 in and removing the process cartridge 21 from the support-body frame 63 described later.

The process handle 96 is disposed in the approximate left-right center region on the top surface of the corresponding cartridge coupling rod 82. The process handle 96 has a general plate shape and, in a front side view, has a general squared U-shape, with the opening of the "U" facing downward.

3. Detailed Description of Cartridge-Supporting Body

Figure 5:
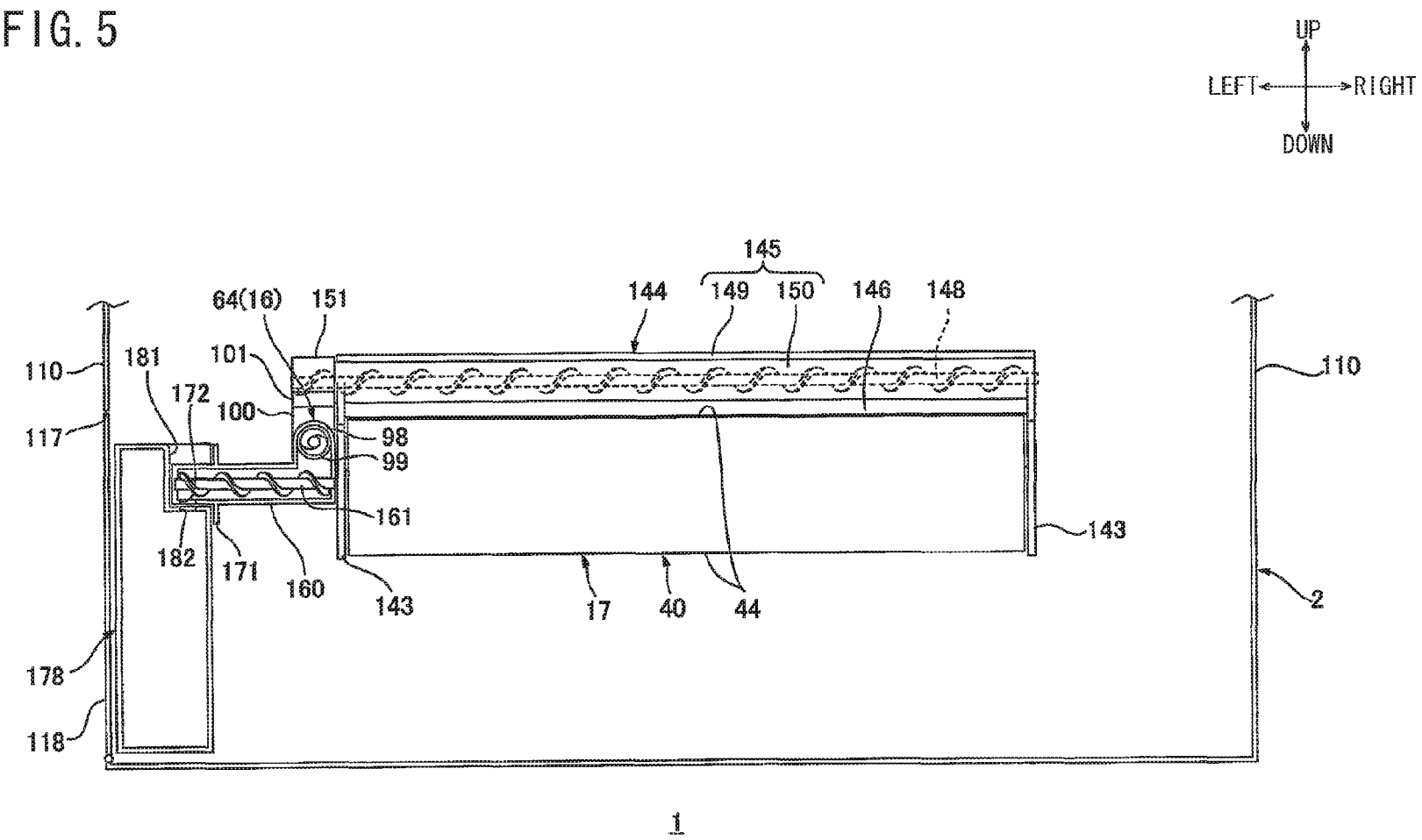
FIG. 5 is a cross-sectional view taken along a line V-V in FIG. 2 showing an assembled state of a waste toner cartridge with respect to a coupling unit, the process cartridge being omitted.

As shown in FIGS. 2 and 5, the cartridge-supporting body 16 includes a support-body frame 63 for supporting the four process cartridges 21, a collective conveying unit 64 for consolidating and conveying waste toner removed from all four process cartridges 21 by the respective drum-cleaning units 81.

(1) Support-Body Frame

As shown in FIGS. 1 and 3, the support-body frame 63 is a frame-like member having a general rectangular shape in a plan view. The support-body frame 63 includes a pair of side support-body walls 67 (see FIG. 3), a front support-body wall 68, a rear support-body wall 69, and three partitioning support-body walls 70.

Figure 7:
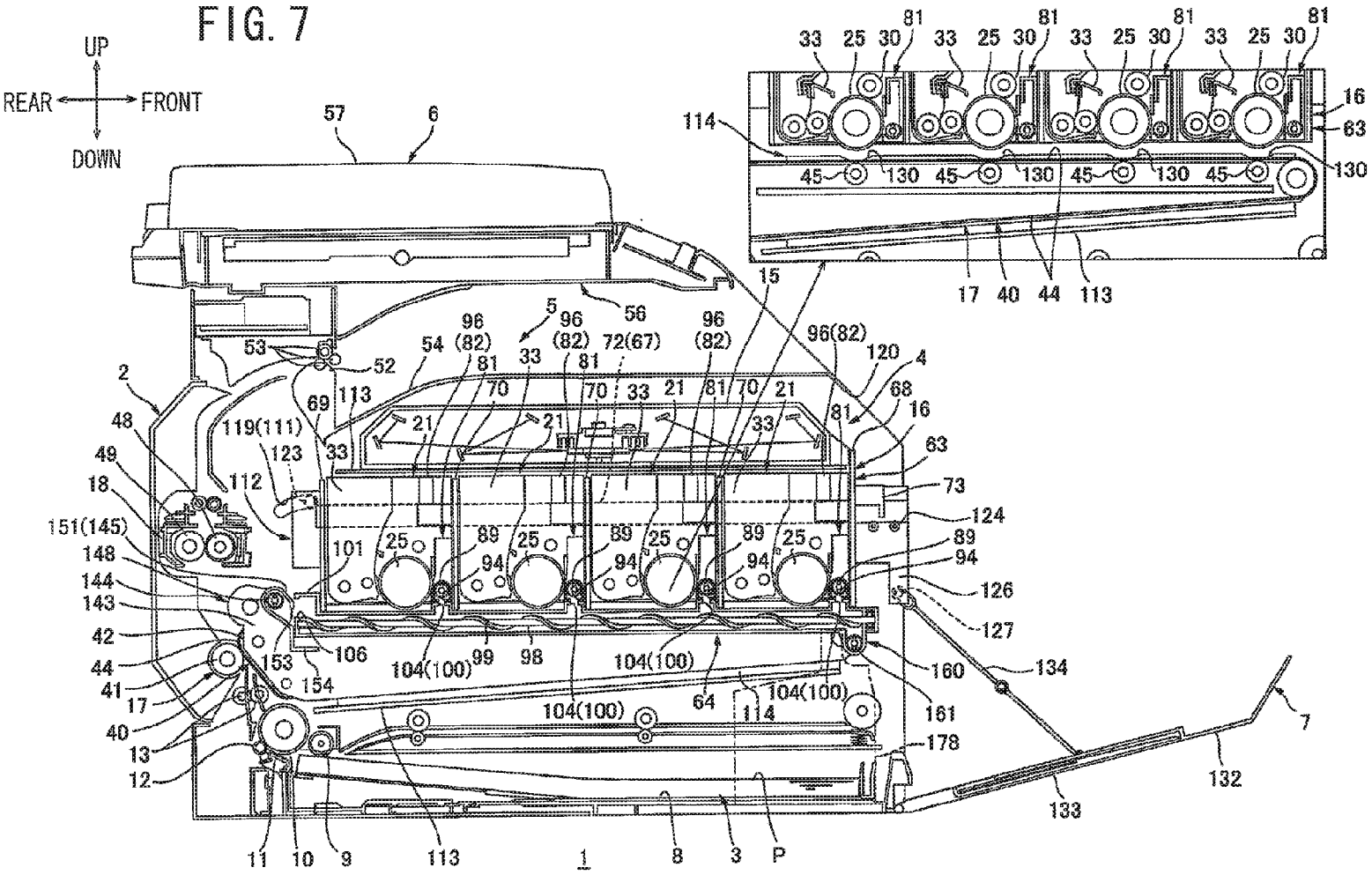
FIG. 7 is a view corresponding to FIG. 2 and showing an internal separated position of the cartridge supporting body.

As shown in FIG. 3, the side support-body walls 67 are separated from each other in the left-right direction. The side support-body walls 67 are plate-like and have a general rectangular shape in a side view that is elongated in the front-rear direction. As shown in FIGS. 3 and 7, each side support-body wall 67 includes a guide rail 72. The guide rail 72 is a ridge-like member that spans the entire front-rear dimension of the corresponding side support-body wall 67. The guide rail 72 protrudes outward in the left-right direction at a position approximately one-third the vertical dimension of the side support-body wall 67 from the top edge of the same.

As shown in FIG. 1, the front support-body wall 68 bridges the front edges of the side support-body walls 67. The front support-body wall 68 is a plate-like member having a general rectangular shape in a front side view and is elongated in the left-right direction. The top edge of the front support-body wall 68 protrudes above the side support-body walls 67. The front support-body wall 68 includes a drawer handle 73 that the user grips when moving the support-body frame 63 relative to the main casing 2.

The drawer handle 73 is a plate-like member having a general L-shape in a side view. Specifically, the drawer handle 73 protrudes first forward from the front surface on the upper portion of the front support-body wall 68, and then bends downward. The user can grip the drawer handle 73 when the support-body frame 63 is attached to or removed from the main casing 2.

The rear support-body wall 69 bridges the rear edges of the side support-body walls 67. The rear support-body wall 69 is a plate-like member having a general rectangular shape in a front side view and is elongated in the left-right direction.

The three partitioning support-body walls 70 are arranged parallel to each other at intervals in the front-rear direction between the front support-body wall 68 and rear support-body wall 69 so as to bridge the side support-body walls 67. The partitioning support-body walls 70 are plate-like members having a general rectangular shape in the front-rear direction and are elongated in the left-right direction.

Figure 8:
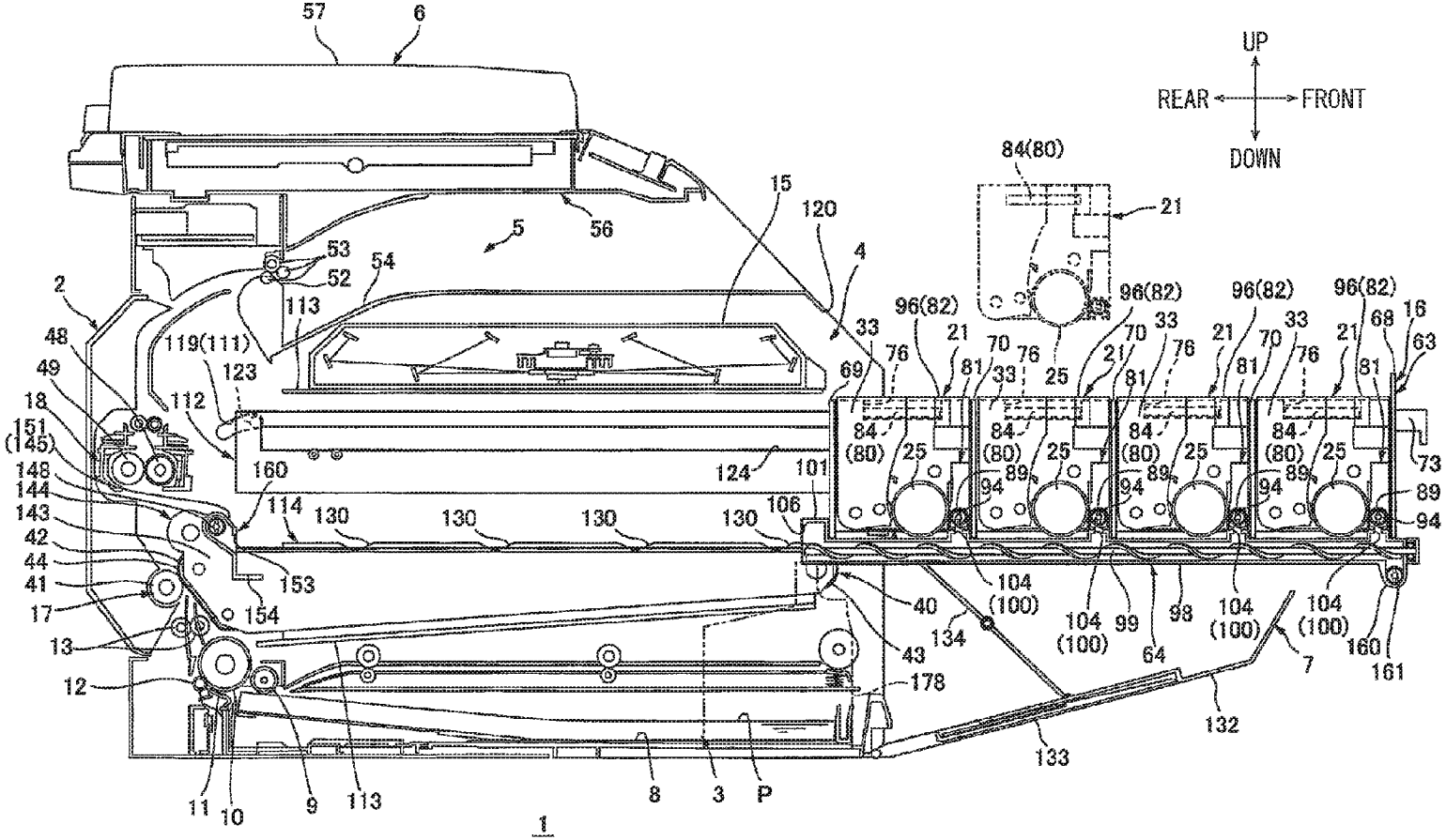
FIG. 8 is a view corresponding to FIG. 2 and showing an external position of the cartridge supporting body.

Spaces in the support-body frame 63 formed between adjacent partitioning support-body walls 70 and the pair of side support-body walls 67 are defined as process-cartridge accommodating sections 75. In addition, the space in the front region of the support-body frame 63 defined by the front support-body wall 68, the forwardmost partitioning support-body wall 70, and the pair of side support-body walls 67 is also defined as a process-cartridge accommodating section 75, while the space in the rear region of the support-body frame 63 defined by the rear support-body wall 69, the rearmost partitioning support-body wall 70, and the side support-body walls 67 is also defined as a process-cartridge accommodating section 75. Hence, four process-cartridge accommodating sections 75 are juxtaposed in the front-rear direction. As illustrated in FIGS. 4 and 8, the four process cartridges 21 are configured to be detachably mountable in corresponding process-cartridge accommodating sections 75 formed in the support-body frame 63.

As shown in FIGS. 2 and 3, receiving grooves 76 are provided one in each side support-body wall 67 within each of the four process-cartridge accommodating sections 75 for receiving the corresponding engaging protrusions 84 of the side cartridge wall 80.

The receiving grooves 76 are recesses formed in the inner left-right surfaces of the corresponding side support-body walls 67. In a plan view, the receiving grooves 76 have a squared U-shape that is open on the inner left-right side and the top. Four of the receiving grooves 76 are formed in each of the side support-body walls 67 at intervals in the front-rear direction. The front-rear dimension of the receiving grooves 76 is shorter than the front-rear dimension of the process-cartridge accommodating sections 75.

As will be described later in greater detail, the support-body frame 63 can be moved by sliding in the front-rear direction, i.e., in the direction that the photosensitive drums 25 are juxtaposed, between an internal position shown in FIGS. 1 and 7 inside the main casing 2, and an external position shown in FIG. 8 outside the main casing 2. Further, while the process cartridges 21 are mounted in the support-body frame 63, the support-body frame 63 can be moved between a contact position shown in FIG. 1 in which the photosensitive drums 25 are in contact with the intermediate transfer belt 44, and a separated position shown in FIG. 7 in which the photosensitive drums 25 are separated from the intermediate transfer belt 44.

As shown in FIG. 3, the bottom of the support-body frame 63 is positioned above the bottoms of the drum bodies 26 and the bottoms of the flanges 27 constituting the photosensitive drums 25 when the support-body frame 63 is in the internal position with the process cartridges 21 mounted therein.

(2) Collective Conveying Unit

As shown in FIGS. 2 and 5, the collective conveying unit 64 includes a collective conveying tube 98, a collective conveying screw 99 as an example of the collective conveying member for consolidating and conveying waste toner received through the input cylinders 100, and a coupling screw 161.

(2-1) Collective Conveying Tube

The collective conveying tube 98 has a general cylindrical shape that is elongated in the front-rear direction and closed on both front and rear ends. The collective conveying tube 98 is disposed below the support-body frame 63 and is supported on the bottom end of the front support-body wall 68, the bottom left end of the rear support-body wall 69, and the bottom left ends of the three partitioning support-body walls 70. The front end of the collective conveying tube 98 extends farther forward than the front side of the support-body frame 63, and the rear end of the collective conveying tube 98 extends farther rearward than the rear side of the support-body frame 63. The portion of the collective conveying tube 98 positioned frontward of the front side of the support-body frame 63 has a vertically penetrated lower part. The collective conveying tube 98 is provided with a plurality of first input cylinders 100, or four cylindrical parts, for receiving waste toner from respective drum cleaning units 81, a second input cylinder 101 for receiving waste toner from the belt cleaning unit 144 to be described later, and the coupling tube 160.

(2-1-1) First Input Cylinders

As shown in FIGS. 2 and 3, the four first input cylinders 100 are arranged at intervals in the front-rear direction. The input cylinders 100 protrude upward from the upper circumferential surface of the collective conveying tube 98 and have a general squared cylindrical shape that is closed on the upper end. Each of the first input cylinders 100 is connected to the collective conveying tube 98 so that the lower portion of each input cylinder 100 is in communication with the collective conveying tube 98. Each of the first input cylinders 100 has an inlet 104 as an example of a first opening for receiving waste toner discharged through the communication hole 94 of the corresponding drum-cleaning unit 81.

The inlet 104 is formed in the upper portion of the first input cylinder 100 and penetrates the central portion in a plan view of the upper portion of the first input cylinder 100 vertically to provide communication between the interior and exterior of the first input cylinder 100.

The inlet 104 formed in each of the four first input cylinders 100 vertically overlaps the communication hole 94 formed in the corresponding drum-cleaning unit 81 when the process cartridges 21 are mounted in the support-body frame 63. Through this construction, the drum-cleaning frame 87 of each drum-cleaning unit 81 is in communication with the collective conveying tube 98 of the collective conveying unit 64.

(2-1-2) Second Input Cylinder

As shown in FIG. 2, a second input cylinder 101 is disposed at the rear portion off the collective conveying unit 64. The second input cylinder 101 projects upward from the upper periphery at the rear portion of the collective conveying tube 98. The second input cylinder 101 has a prism shape with the upper end sealed. The lower end portion of the second input cylinder 101 is connected to the collective conveying tube 98 so that the interior of the second input cylinder 101 is in communication with the collective conveying tube 98. The second input cylinder 101 is formed with a belt waste toner receiving opening 106 as an example of a second opening for receiving waste toner from a belt cleaning unit 144 described later.

The belt waste toner receiving opening 106 penetrates in the front-rear direction into the upper part of the rear wall of the second input cylinder 101 so as to be communicable between the exterior and interior of the second input cylinder 101.

(2-1-3) Coupling Tube

As shown in FIG. 5, a coupling tube 160 is disposed in the rear left side of the transfer unit 17 and in a front lower position of the collective conveying unit 64. The coupling tube 160 extends in left-right direction and has a generally cylindrical shape with both ends sealed. The upper right portion of the coupling tube 160 is connected to the periphery of the collective conveying tube 98 corresponding to the penetrated portion in the front lower portion formed therein so that the interior of the coupling tube 98 is in communication with the collective conveying tube 98. The coupling tube 160 is formed with a collective toner ejecting opening 172 as an example of a third opening, and an abutment portion 171.

The collective toner ejecting opening 172 is formed in the coupling tube 160 to penetrate vertically in the lower left portion of the coupling tube 160.

The abutment portion 171 has a generally annular shape and projects radially outward from the outer periphery of the coupling tube 160 at a position right-side of the collective toner ejecting opening 172.

(2-2) Collective Conveying Screw

As shown in FIGS. 2 and 3, the collective conveying screw 99 is disposed inside the collective conveying tube 98. The collective conveying screw 99 is a right-handed auger screw feeder having a rotational shaft aligned in the front-rear direction. The front and rear ends of the rotational shaft in the collective conveying screw 99 are rotatably supported in the corresponding front and rear walls of the collective conveying tube 98.

As will be described later in greater detail, the collective conveying tube 98 functions to allow passage of waste toner removed from the drum bodies 26 and introduced through the four first input cylinders 100 and also passage of waste toner removed from the intermediate transfer belt 44 and introduced through the second input cylinder 101.

(2-3) Coupling Screw

The coupling screw 161 is disposed inside the coupling tube 160. The coupling screw 161 is a right-handed auger screw with a rotational shaft that extends in the left-right direction. The left and right ends of the rotational shaft in the coupling screw 161 are rotatably supported in the left and right walls of the coupling tube 160.

More specifically, the coupling tube 160 is such a tube that functions to allow passage of waste toner removed from the drum bodies 26 by the respective drum cleaning blades 88 and conveyed by the collective conveying unit 64 and also passage of waste toner removed from the intermediate transfer belt 44 by the belt cleaning blade 146.

4. Detailed Description of Main Casing (1) Frame Structure of Main Casing

As shown in FIG. 3, the main casing 2 includes a pair of outer casing side walls 110, a pair of inner casing side walls 111, a pair of guiding walls 112, a pair of side-wall connecting plates 113, a pair of positioning plates 114, and the front cover 7 described above.

(1-1) Outer Casing Side Walls

Figure 6:
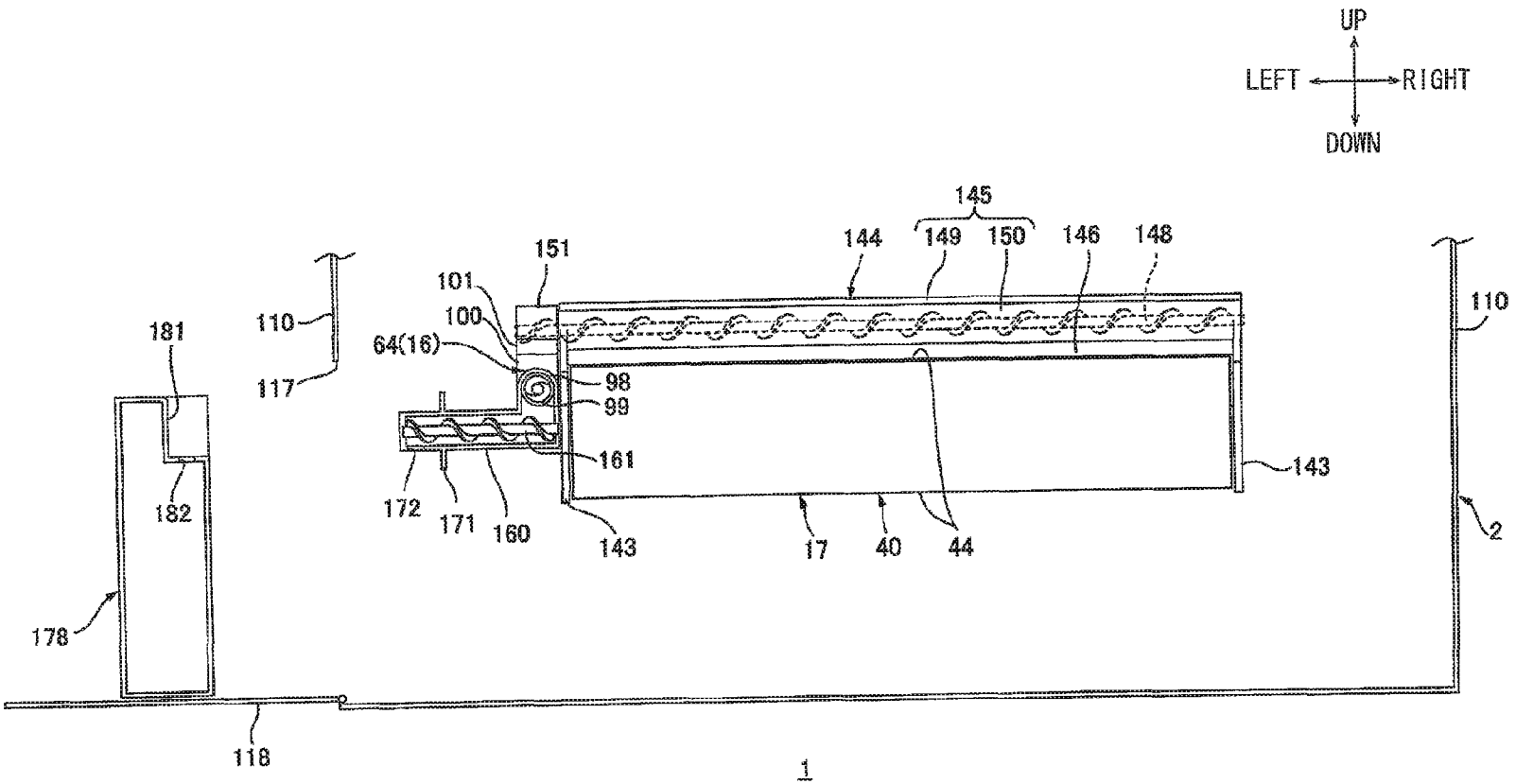
FIG. 6 is a cross-sectional view taken along the line V-V in FIG. 2 showing a disassembled state of a waste toner cartridge with respect to the coupling unit, the process cartridge being omitted.

The outer casing side walls 110 are spaced apart from each other in the left-right direction. The outer casing side walls 110 are plate-like members having a general rectangular shape in a side view and are elongated in the front-rear direction. As shown in FIGS. 5 and 6, the left outer casing side wall 110 includes a waste-toner-unit access opening 117, and a side cover 118.

The waste-toner-unit access opening 117 penetrates the lower front portion of the left outer casing side wall 110 in the left-right direction. The waste-toner-unit access opening 117 has dimensions sufficient for allowing passage of a waste toner box 178 described later.

The side cover 118 is a plate-like member having a general rectangular shape in a side view. The side cover 118 can be pivoted about the bottom edge of the waste-toner-unit access opening 117 between a closed position shown in FIG. 5, and an open position shown in FIG. 6.

(1-2) Inner Casing Side Walls

As shown in FIG. 3, the inner casing side walls 111 are spaced apart from each other in the left-right direction and are disposed further inward than the outer casing side walls 110 in the left-right direction. The inner casing side walls 111 are plate-like members having a rectangular shape in a side view and are elongated in the front-rear direction. As shown in FIGS. 1 and 3, each of the inner casing side walls 111 has a pair of front and rear curved grooves 119.

The curved grooves 119 are spaced apart from each other in the front-rear direction and are disposed at positions approximately one-fourth the vertical dimension of the corresponding inner casing side wall 111 from the top edge of the same. The curved grooves 119 are recessed into the inner left-right surface of the corresponding inner casing side wall 111. As shown in FIG. 1, the curved grooves 119 have a uniform width and extend in a direction sloping upward toward the front. The center region of the curved groove 119 is deflected slightly upward to the rear to give the curved groove 119 a general arc shape in a side view.

A cartridge-support-body access opening 120 is defined as the space between the front ends of the inner casing side walls 111. The cartridge-support-body access opening 120 penetrates the front wall of the main casing 2 in the front-rear direction.

(1-3) Guiding Walls

As shown in FIG. 3, the guiding walls 112 are spaced apart from each other in the left-right direction and are disposed at positions further inward in the left-right direction from the corresponding inner casing side walls 111. As shown in FIGS. 1 and 3, the guiding walls 112 are plate-like members having a rectangular shape in a side view and are elongated in the front-rear direction. Each guiding wall 112 includes a guiding groove 124, an extended part 126, an engaging shaft 127, and a pair of front and rear guiding shafts 123.

The guiding groove 124 is a recess formed in the inner left-right surface of the guiding wall 112 at a position approximately one-third the vertical dimension of the guiding wall 112 from the top edge of the same and extends from the front edge of the guiding wall 112 to a position near the rear edge. The guiding groove 124 receives the guide rail 72 on the corresponding side support-body wall 67 of the support-body frame 63 so that the guide rail 72 can slide in the front-rear direction.

As shown in FIG. 1, the extended part 126 is a plate-like member having a general rectangular shape in a side view. The extended part 126 protrudes downward from the lower front edge of the guiding wall 112.

The engaging shaft 127 has a general columnar shape and protrudes outward in the left-right direction from the outer left-right surface of the corresponding extended part 126 near the bottom edge thereof. The engaging shaft 127 engages with the distal end of an interlocking part 134 (described later) of the front cover 7.

The guiding shafts 123 are spaced apart from each other in the front-rear direction, with one disposed on the upper front end and one on the upper rear end of the corresponding guiding wall 112. As shown in FIGS. 1 and 3, the guiding shafts 123 have a general columnar shape and protrude outward in the left-right direction from the outer left-right surface of the corresponding guiding wall 112. Each of the guiding shafts 123 is inserted into the corresponding curved groove 119 formed in the inner casing side wall 111 and is capable of moving within the curved groove 119.

With this configuration, the guiding walls 112 are capable of translating relative to the inner casing side wall 111 in a direction diagonally upward and forward, with the guiding shafts 123 moving within the corresponding curved grooves 119 of the inner casing side walls 111 from the lower rear ends of the curved grooves 119 to the upper front ends.

(1-4) Side-Wall Connecting Plates

As shown in FIGS. 1 and 3, the side-wall connecting plates 113 bridge the upper ends and the lower ends of the inner casing side walls 111. The upper side-wall connecting plate 113 is disposed beneath the scanning unit 15, while the lower side-wall connecting plate 113 is disposed beneath the transfer unit 17 and above the sheet supply unit 3. The lower side-wall connecting plate 113 has a plate-like shape that slopes upward from the rear side toward the front side so as to follow the bottom portion of the intermediate transfer belt 44.

(1-5) Positioning Plates

As shown in FIGS. 2 and 3, the positioning plates 114 are disposed on the top surface of the lower side-wall connecting plate 113, with one on the left portion of the side-wall connecting plate 113 and one on the right portion. The left positioning plate 114 overlaps the collective conveying tube 98 of the collective conveying unit 64 in the left-right direction and is positioned on the right side of the collective conveying tube 98 when the support-body frame 63 is in the internal position. In other words, the collective conveying tube 98 is positioned outside of the left positioning plate 114 with respect to the left-right direction. The positioning plates 114 are plate-like members having a general rectangular shape in a side view and are elongated in the front-rear direction. The bottom ends of the positioning plates 114 are bent rightward so as to slope upward from the rear side toward the front side. The top edges of the positioning plates 114 are aligned in the front-rear direction. Each positioning plate 114 includes four positioning recesses 130.

The four positioning recesses 130 are spaced at intervals along the front-rear direction. The positioning recesses 130 are recesses formed in the top edges of the positioning plates 114 and have a general arc shape in a side view. The positioning recesses 130 are shaped to conform with the peripheral edges of the flanges 27 constituting the photosensitive drums 25. In a left-right projection, the bottom edges of the positioning recesses 130 are approximately aligned with the upper portion of the intermediate transfer belt 44.

(1-6) Front Cover

As described above, the front cover 7 can pivot between the closed position shown in FIG. 1, and the open position shown in FIG. 7. As shown in FIG. 1, the front cover 7 includes a cover body 132, a manual feed tray 133, and an interlocking part 134.

The cover body 132 is a plate-like member having a general rectangular shape in a front view and is elongated vertically, with the upper end sloping rearward. The cover body 132 has dimensions sufficient for covering the cartridge-support-body access opening 120.

The manual feed tray 133 is disposed in the approximate vertical center region of the cover body 132. The manual feed tray 133 is a plate-like member having a general rectangular shape in a side view and is elongated in the left-right direction. The manual feed tray 133 can be rotated forward and downward about the bottom edge of the cover body 132.

As shown in FIGS. 1 and 7, the interlocking part 134 has a general rod shape that is capable of folding in the approximate center region of its longitudinal dimension. The base end of the interlocking part 134 is connected to the approximate vertical center of the cover body 132. The distal end of the interlocking part 134 is engaged with the engaging shaft 127 on the guiding wall 112.

(2) Cleaning Configuration in Main Casing

As shown in FIGS. 1 and 5, the belt unit 40 described above, the waste toner box 178 as an example of a waste toner cartridge are provided on the main casing 2.

(2-1) Belt Unit

The belt unit 40 extends in the front-rear direction and is positioned beneath all of the photosensitive drums 25. The belt unit 40 includes the drive roller 42, the follow roller 43, the tension roller 46, and the intermediate transfer belt 44 and the primary transfer rollers 45 described earlier.

The drive roller 42 is rotatably supported in the rear end of the belt unit 40. The follow roller 43 is rotatably supported in the front end of the belt unit 40. The tension roller 46 is rotatably supported in the belt unit 40 at a position below and forward of the drive roller 42.

The intermediate transfer belt 44 is looped around the drive roller 42, the follow roller 43, and the tension roller 46 so that it's top portion contacts the bottom surfaces of all photosensitive drums 25. As the drive roller 42 drives and the follow roller 43 follows, the intermediate transfer belt 44 circulates such that its top portion moves forward. The tension roller 46 serves to apply tension to the intermediate transfer belt 44 by pressing downward on the bottom portion of the intermediate transfer belt 44.

The four primary transfer rollers 45 are disposed inside the loop formed by the intermediate transfer belt 44 and are arranged at intervals in the front-rear direction between the drive roller 42 and follow roller 43. The primary transfer rollers 45 are positioned beneath the corresponding photosensitive drums 25, with the top portion of the intermediate transfer belt 44 interposed therebetween so that the primary transfer rollers 45 contact the upper portion of the intermediate transfer belt 44 from below.

The belt unit 40 includes side belt unit plates 143, and a belt-cleaning unit 144 for removing waste toner from the surface of the intermediate transfer belt 44.

(2-1-1) Side Belt Unit Plates

As shown in FIGS. 2 and 3, the side belt unit plates 143 constitute the left and right ends of the belt unit 40. The side belt unit plates 143 are spaced apart from each other in the left-right direction and are positioned inside the corresponding positioning plates 114 in the left-right direction. The side belt unit plates 143 are plate-like members having a general rectangular shape in a side view and are elongated in the front-rear direction. The top edges of the side belt unit plates 143 are aligned in the front-rear direction, while the bottom edges slope upward from the rear side toward the front side along the slope of the side-wall connecting plates 113. The rear ends of the side belt unit plates 143 protrude upward and function to close the left and right ends of a belt-cleaning frame 145 (described later).

(2-1-2) Belt-Cleaning Unit

As shown in FIG. 1, the belt-cleaning unit 144 is disposed above the drive roller 42, with the intermediate transfer belt 44 interposed therebetween. Thus, the belt-cleaning unit 144 is positioned farther rearward than the rearmost photosensitive drum 25 when the support-body frame 63 is in the internal position and supports the process cartridges 21. The belt-cleaning unit 144 includes a belt-cleaning frame 145, a belt-cleaning blade 146 as an example of a belt cleaning member, a belt-cleaning brush roller 147, and a belt-cleaning screw 148 as an example of a conveying member.

The belt-cleaning frame 145 further includes a brush roller accommodating section 149, a screw accommodating section 150, and an extension part 151.

As shown in FIG. 5, the brush roller accommodating section 149 has a general cylindrical shape that is elongated in the left-right direction. The side belt unit plates 143 close the left and right ends of the brush roller accommodating section 149. An opening is formed in the bottom of the brush roller accommodating section 149 and vertically penetrates the bottom of the brush roller accommodating section 149 across its entire left-right dimension.

As shown in FIGS. 1 and 5, the screw accommodating section 150 has a general cylindrical shape and is elongated in the left-right direction. The screw accommodating section 150 is adjacent to the brush roller accommodating section 149 on the front side, with its interior in communication with the interior of the brush roller accommodating section 149. The screw accommodating section 150 has a smaller diameter than the brush roller accommodating section 149. As shown in FIG. 5, the right side belt unit plate 143 closes the right end of the screw accommodating section 150. Thus, the right end of the screw accommodating section 150 is flush with the right end of the brush roller accommodating section 149. The left end of the screw accommodating section 150 extends farther leftward than the left end of the brush roller accommodating section 149. In other words, the screw accommodating section 150 has a greater left-right direction than the brush roller accommodating section 149.

As shown in FIG. 2, the extension part 151 extends from the left portion of the screw accommodating section 150 toward the front lower portion thereof, and then is generally prism-shaped with the upper and lower ends sealed. The upper part in the right wall of the extension part 151 is connected to the left portion of the screw accommodating section 150 so that the interior of the extension part 151 is in communication with the screw accommodating section 150. The front lower portion of the extension part 151 extends vertically. The extension part 151 is formed with a belt waste toner ejection opening 153 and a mounting section 154.

The belt waste toner ejection opening 153 penetrates the front lower portion of the extension part 151 in the front-rear direction.

The mount section 154 extends downward from the lower periphery of the belt waste toner ejection opening 153, and then bent toward the front direction so as to be generally L-shaped in a side view.

As shown in FIG. 1, the belt-cleaning blade 146 is disposed in the lower front portion of the brush roller accommodating section 149. The belt-cleaning blade 146 is a plate-like member that is elongated in the left-right direction and has substantial thickness along a direction that slopes upward toward the rear. The upper front portion of the belt-cleaning blade 146 is fixed to the front peripheral edge of the brush roller accommodating section 149 defining the opening in the bottom of the same. The lower rear portion of the belt-cleaning blade 146 confronts the front half of the opening formed in the brush roller accommodating section 149. The lower rear edge of the belt-cleaning blade 146 contacts the top surface of the intermediate transfer belt 44 near the rear end thereof.

The belt-cleaning brush roller 147 is disposed inside the brush roller accommodating section 149. The belt-cleaning brush roller 147 is a brush roller having a flocked surface and has a rotational shaft aligned in the left-right direction. The left and right ends of the rotational shaft in the belt-cleaning brush roller 147 are rotatably supported in the side belt unit plates 143 that close the left and right ends of the brush roller accommodating section 149.

The belt-cleaning screw 148 is disposed in the screw accommodating section 150. As shown in FIG. 5, the belt-cleaning screw 148 is a left-handed auger screw feeder having a rotational shaft that is oriented in the left-right direction. The right end of the rotational shaft in the belt-cleaning screw 148 is rotatably supported in the coupling unit 140 that closes the right end of the screw accommodating section 150. The left end of the rotational shaft in the belt-cleaning screw 148 protrudes farther leftward than the left end of the screw accommodating section 150 and is rotatably supported in the left wall of the extension part 151.

As will be described later in greater detail, the belt-cleaning frame 145 is a conveying tube configured to allow passage of waste toner that has been scraped off the intermediate transfer belt 44 by the belt-cleaning blade 146.

(2-2) Waste Toner Box

As shown in FIGS. 1 and 5, the waste toner box 178 is disposed on the left end of the coupling tube 160 of the collective conveying unit 64. That is, the waste toner box 178 is disposed farther frontward than the rearmost photosensitive drum 25 when the support-body frame 63 that supports the process cartridges 21 is in the internal position. The waste toner box 178 is detachably mounted on the coupling tube 160 of the collective conveying unit 164. The waste toner box 178 has a box-like shape that is elongated in the vertical and front-rear directions. The top end of the waste toner box 178 protrudes upward. The waste toner box 178 includes a receiving part 181, and a waste toner inlet 182.

The receiving part 181 is depressed in the form of a rectangular shape in a side view. The depression starts from the right wall of the upper projected portion of the waste toner box 178 and extends in the leftward direction. The front side and the upper side of the receiving part 181 are open. The left end of the receiving part 181 is positioned at approximately center farther leftward than the approximate left-right center of the waste toner box 178. The receiving part 181 is configured to receive the left end portion of the coupling tube 160 therein.

The waste toner inlet 182 vertically penetrates the bottom portion of the receiving part 181.

When the left end portion of the coupling tube 160 is received in the receiving part 181, the peripheral edge of the right end portion of the receiving part 181 is in contact with the left end portion of the abutment portion 171. At this time, the waste toner inlet 182 vertically overlaps the collective toner ejecting opening 172 of the coupling tube 160. Thus, the waste toner box 178 is in communication with the coupling tube 160 of the collective conveying unit 64.

(2-3) Mounting and Removal of Waste Toner Box Relative to Coupling Tube

The waste toner box 178 can be inserted into and removed from the coupling tube 160 of the collective conveying unit 64 through the waste-toner-unit access opening 117.

To remove the waste toner box 178 from the coupling tube 160, first the user exposes waste-toner-unit access opening 117 by pivoting the side cover 118 of the outer casing side wall 110 leftward and downward about its bottom edge, as shown in FIG. 6. Next, the user pulls the waste toner box 178 leftward through the waste-toner-unit access opening 117 until the coupling tube 160 of the collective conveying unit 64 is extracted from the receiving part 181 of the waste toner box 178. Through this operation, the waste toner inlet 182 is no longer in communication with the collective toner ejecting opening 172.

To mount the waste toner box 178 in the coupling tube 160 of the collective conveying unit 64, the steps of the above operation are performed in reverse. That is, the user pushes the waste toner box 178 into the main casing 2 through the waste-toner-unit access opening 117 so that the receiving part 181 receives the coupling tube 160, as shown in FIG. 5. Through this operation, the receiving part 181 of the waste toner box 178 is aligned with and in contact with the left end portion of the abutment portion 171.

Through this operation, the waste toner inlet 182 is now aligned vertically with the collective toner ejecting opening 172 so that the waste toner box 178 is in communication with the coupling tube 160 of the collective conveying unit 64.

5. State of the Support-Body Frame in Contact Position

As shown in FIGS. 1 and 3, the support-body frame 63 is slidably supported in the main casing 2 while the process cartridges 21 are mounted in the support-body frame 63, with the guide rails 72 inserted in the guiding grooves 124 of the guiding walls 112. When the support-body frame 63 is in the internal position, the rear surface on the top edge of the front support-body wall 68 constituting the support-body frame 63 is in contact with the front end of the scanning unit 15.

Here, the guiding shafts 123 of the guiding walls 112 are positioned in the lower rear ends of the corresponding curved grooves 119 formed in the inner casing side walls 111. Accordingly, the photosensitive drums 25 in the four process cartridges 21 supported in the support-body frame 63 are in contact with the top edges of the positioning plates 114. More specifically, the flanges 27 on the four photosensitive drums 25 are received in the corresponding positioning recesses 130. Thus, the positioning plates 114 position the four photosensitive drums 25 so that the drum bodies 26 are in contact with the upper portion of the intermediate transfer belt 44 and are positioned relative to the scanning unit 15. At this time, the support-body frame 63 is in the internal position, and specifically the contact position (hereinafter this will be called the "internal contact position").

Note that when the support-body frame 63 is in the internal contact position while the process cartridges 21 are mounted therein, the rear end portion of the collective conveying tube 98 of collective conveying unit 64 is placed on the mounting section 154 of the belt cleaning unit 144. At this time, the belt waste toner receiving opening 106 of the collective conveying unit 64 overlaps the belt waste toner ejection opening 153 of the belt cleaning unit 144 in the front-rear direction. Consequently, the collective conveying tube 98 of the collective conveying unit 64 is in communication with the belt cleaning frame 145 of the belt cleaning unit 144.

When the support-body frame 63 is in the internal contact position while the process cartridges 21 are mounted therein, The waste toner inlet 182 of the waste toner box 178 vertically overlaps the collective toner ejecting opening 172 of the coupling tube 160 as shown in FIG. 5. Consequently, the waste toner box 178 is in communication with the coupling tube 160 of the collective conveying tube 98.

6. Operations for Recovering Waste Toner from Photosensitive Drums and Intermediate Transfer Belt Next, the operations of the printer 1 will be described for collecting waste toner from the photosensitive drums 25 and the intermediate transfer belt 44.

(1) Waste Toner Collection Operation of Belt-Cleaning Unit

The belt-cleaning unit 144 removes waste toner and other matter deposited on the intermediate transfer belt 44. As shown in FIG. 1, the belt-cleaning blade 146 scrapes waste toner and other deposited matter off the intermediate transfer belt 44, and the deposited matter is collected in the brush roller accommodating section 149 of the belt-cleaning frame 145.

The rotating belt-cleaning brush roller 147 then conveys the waste toner and other deposited matter collected in the brush roller accommodating section 149 toward the front side of the belt-cleaning frame 145 and, hence, toward the screw accommodating section 150.

The belt-cleaning screw 148 in the screw accommodating section 150 rotates to convey the waste toner and other deposited matter toward the left end of the screw accommodating section 150. In this way, waste toner and other deposited matter removed from the intermediate transfer belt 44 and conveyed to the left end of the screw accommodating section 150 flows into the extension part 151.

The waste toner and other deposited matter removed from the intermediate transfer belt 44 and introduced in the extension part 151 drops down into the collective conveying tube 98 of the collective conveying unit 64 through the belt waste toner ejection opening 153 and the belt waste toner receiving opening 106.

(2) Waste Toner Collection Operations of Drum Cleaning Unit and Collective Conveying Unit The drum-cleaning unit 81 removes waste toner and other matter deposited on the drum body 26 of the corresponding photosensitive drum 25. More specifically, the drum-cleaning blade 88 scrapes waste toner and other deposited matter from the drum body 26 of the corresponding photosensitive drum 25, and this deposited matter is collected in the drum-cleaning frame 87, as shown in FIGS. 1 and 3.

Next, the drum-cleaning screw 89 in the drum-cleaning frame 87 rotates so as to convey the waste toner and other deposited matter accumulated in the drum-cleaning frame 87 toward the left end of the drum-cleaning frame 87 and, hence, toward the left frame protrusion 92.

Deposited matter conveyed to the left frame protrusion 92 passes through the communication hole 94 and inlet 104 and falls into the input cylinder 100. In the input cylinder 100, the deposited matter continues to flow into the collective conveying tube 98.

With the collective conveying screw 99 rotating in the collective conveying tube 98, as shown in FIG. 2, the collective conveying unit 64 then conveys the waste toner and other deposited matter removed from the drum bodies 26 of the photosensitive drums 25 and introduced into the collective conveying tube 98 rearward.

Hence, waste toner and other deposited matter removed from the drum bodies 26 of the photosensitive drums 25 by the corresponding drum-cleaning units 81 can be collected in the collective conveying tube 98 through the four input cylinders 100 and conveyed altogether.

With the collective conveying screw 99 rotating in the collective conveying tube 98, the collective conveying unit 64 conveys rearward the waste toner and other deposited matter removed from the intermediate transfer belt 44 and introduced into the collective conveying tube 98 through the belt waste toner receiving opening 106.

Then, as shown in FIGS. 2 and 5, waste toner and other deposited matter removed from the intermediate transfer belt 44 are consolidated in the collective conveying tube 98 and drops into the coupling tube 160.

The coupling unit 140 collects waste toner and other deposited matter removed from the drum bodies 26 of the photosensitive drums 25 by the corresponding drum-cleaning units 81 and waste toner and other deposited matter removed from the intermediate transfer belt 44 by the belt-cleaning unit 144 inside the coupling tube 160 and conveys this deposited matter toward the waste toner box 178. More specifically, waste toner and other deposited matter removed from the intermediate transfer belt 44 is conveyed from the right end portion of the coupling tube 160 toward the left end portion of the coupling tube 160 by the rotations of the coupling screw 161.

Waste toner and other deposited matter removed from the intermediate transfer belt 44 and from the drum bodies 26 of the plurality of photosensitive drums 25 drop down through the collective toner ejecting opening 172 and the waste toner inlet 182 and into the waste toner box 178. The waste toner and other deposited matter are introduced into and stored in the waste toner box 178.

Thus, all waste toner and other deposited matter removed from the intermediate transfer belt 44 of the belt cleaning unit 144 and from the drum bodies 26 of the photosensitive drums 25 can be stored together in the waste toner box 178.

7. Operations for Moving Drawer Frame (1) Moving Cartridge Support Body from Internal Position to External Position First, the operations for moving the cartridge-supporting body 16 from the internal contact position to the separated position will be described.

While the cartridge-supporting body 16 is in the internal contact position inside the main casing 2, as shown in FIG. 2, the user moves the front cover 7 of the main casing 2 from its closed position to its open position. Through this operation, the cartridge-supporting body 16 moves from the contact position to the separated position shown in FIG. 7. Specifically, as the front cover 7 moves from the closed position to the open position, the front cover 7 applies a tensile force to the interlocking part 134 and pulls the left guiding wall 112 forward via the interlocking part 134. Through this operation, the guiding shafts 123 move within the corresponding curved grooves 119 of the inner casing side walls 111 from the lower rear end to the upper front end, causing the guiding walls 112 to move upward and forward.

The cartridge-supporting body 16 moves upward in the main casing 2 along with the movement of the guiding walls 112. As a result, the four photosensitive drums 25 separate from the four positioning recesses 130 provided in each positioning plate 114. The collective conveying tube 98 of the collective conveying unit 64 also moves upward relative to the mounting section 154 of the belt cleaning unit 144 at this time, removing communication between the belt waste toner receiving opening 106 of the collective conveying tube 98 and the belt waste toner ejection opening 153 of the belt-cleaning frame 145.

At the same time, the coupling tube 160 of the collective conveying unit 64 moves upward relative to the receiving part 181 of the waste toner box 178, removing communication between the collective toner ejecting opening 172 of the coupling tube 160 and the waste toner inlet 182 of the waste toner box 178.

These operations complete movement of the cartridge-supporting body 16 from the internal contact position to the internal separated position.

Next, movement of the cartridge-supporting body 16 from the internal separated position to the external position will be described.

While the cartridge-supporting body 16 is in the separated position shown in FIG. 7, the user grips the drawer handle 73 and pulls the cartridge-supporting body 16 forward from the internal position (internal separated position) to the external position shown in FIG. 8. At this time, the cartridge-supporting body 16 slides forward with the guide rails 72 guided in the guiding grooves 124. In this way, the user pulls the cartridge-supporting body 16 out of the main casing 2 through the cartridge-support-body access opening 120, as shown in FIG. 8.

This completes the operation to move the cartridge-supporting body 16 from the internal separated position to the external position. Once the cartridge-supporting body 16 has been placed in the external position in this way, the user can pull the process cartridges 21 upward to remove them from the cartridge-supporting body 16, as illustrated in phantom in FIG. 8.

(2) Moving Cartridge-Supporting Body from External Position to Internal Position First, the operation for moving the cartridge-supporting body 16 from the external position to the internal separated position will be described.

When the user pushes the cartridge-supporting body 16 rearward, the cartridge-supporting body 16 slides from the external position to the separated position while the guide rails 72 are guided in the guiding grooves 124. Once the cartridge-supporting body 16 arrives in the separated position, the rear surface on the top edge of the front support-body wall 68 constituting the support-body frame 63 contacts the front side of the scanning unit 15, as shown in FIG. 7. At this time, the four photosensitive drums 25 are positioned above their corresponding positioning recesses 130 while being separated vertically therefrom.

This completes the operation to move the support-body frame 63 from the external position to the internal separated position.

Next, the operation to move the cartridge-supporting body 16 from its internal separated position to the internal contact position will be described.

To perform this operation, the user moves the front cover 7 from its open position to its closed position. As the front cover 7 moves toward the closed position, the tensile force that the interlocking part 134 applies to the guiding walls 112 is cancelled. Accordingly, the guiding walls 112 move downward by their own weight as the guiding shafts 123 move to the lower rear ends of the corresponding curved grooves 119. Since the front support-body wall 68 of the support-body frame 63 is in contact with the front end of the scanning unit 15 at this time, the guiding walls 112 move downward without moving rearward.

Consequently, the four photosensitive drums 25 are received in the corresponding positioning recesses 130 and positioned thereby while being in contact with the intermediate transfer belt 44, as shown in FIG. 1.

At the same time, the collective conveying tube 98 of the collective conveying unit 64 is placed on the mounting section 154 of the belt cleaning unit 144 and the belt waste toner receiving opening 106 formed in the collective conveying tube 98 is aligned in the front-rear direction and is in communication with the belt waste toner ejection opening 153 of the belt-cleaning frame 145.

Further, at the same time, the coupling tube 160 of the collective conveying unit 64 is received in the receiving part 181 of the waste toner box 178, and the collective toner ejecting opening 172 formed in the coupling tube 160 is vertically aligned and in communication with the waste toner inlet 182 of the waste toner box 178.

As the results, the support-body frame 63 has moved from its separated position to its contact position.

8. Operational Advantages (1) As shown in FIG. 1, the printer 1 includes the main casing 2, the four process cartridges 21, the cartridge-supporting body 16, the intermediate transfer belt 44, the belt-cleaning unit 144, and the waste toner box 178.

Each of the four process cartridges 21 includes the photosensitive drum 25, and the drum-cleaning unit 81 for collecting waste toner from the photosensitive drum 25.

As shown in FIGS. 1 and 8, the cartridge-supporting body 16 is configured to support the four process cartridges 21 while being able to move between the internal position inside the main casing 2 and the external position outside the main casing 2.

The intermediate transfer belt 44 is disposed in a position for confronting the four photosensitive drums 25 when the cartridge-supporting body 16 is in the internal position while supporting the process cartridges 21.

The belt-cleaning unit 144 is configured to collect waste toner from the surface of the intermediate transfer belt 44.

As shown in FIGS. 2 and 5, the waste toner box 178 is configured to accommodate waste toner recovered from the photosensitive drums 25 by the corresponding drum-cleaning units 81, and waste toner recovered from the intermediate transfer belt 44 by the belt-cleaning unit 144.

The cartridge-supporting body 16 also includes the collective conveying unit 64 that aggregates and consolidates waste toner collected from the photosensitive drums 25 by the corresponding drum-cleaning units 81 for all four process cartridges 21 and waste toner collected from the intermediate transfer belt 44 by the belt cleaning unit 144, and that conveys the consolidated waste toner to the waste toner box 178.

This construction enables the printer 1 to consolidate all waste toner collected from the four photosensitive drums 25 by the corresponding drum-cleaning units 81 and waste toner collected from the intermediate transfer belt 44 by the belt-cleaning unit 144 into a single waste toner box 178.

Hence, this construction enables the printer 1 to be made more compact than a structure in which the receptacle for collecting waste toner from the photosensitive drums 25 is provided separately from a receptacle for collecting waste toner from the intermediate transfer belt 44.

Further, providing a single receptacle for collecting waste toner rather than a plurality of receptacles makes disposal of the waste toner easier.

(2) As shown in FIG. 2, the collective conveying unit 64 is configured to convey waste toner collected from the photosensitive drums 25 by the corresponding drum-cleaning units 81 and waste toner collected from the intermediate transfer belt 44 by the belt-cleaning unit 144 in the front-rear direction.

With this structure, as shown in FIG. 2, the collective conveying unit 64 can convey waste toner collected from the photosensitive drums 25 by the four drum cleaning unit 81 and waste toner collected from the intermediate transfer belt 44 by the belt cleaning unit 144 rearward. The collective conveying unit 64 can certainly consolidate all waste toner therein.

(3) As shown in FIGS. 2 and 5, the collective conveying unit 64 is provided with the collective conveying tube 98 for allowing passage of waste toner therethrough and extending in the front-rear direction.

The collective conveying tube 98 has the inlet 104 that receives waste toner conveyed by the drum-cleaning unit 81, the belt waste toner receiving opening 106 that receives waste toner conveyed by the belt cleaning unit 144, and the collective toner ejecting opening 172 through which the waste toner is supplied into the waste toner box 178.

With this construction, waste toner conveyed by the drum-cleaning units 81 can be received in the collective conveying tube 98 of the collective conveying unit 64 through the inlet 104, and waste toner from the belt cleaning unit 144 is received through the belt waste toner receiving opening 106, and these waste toner is collectively conveyed to the waste toner box 178 through the collective toner ejecting opening 172. Thus, this construction reduces the risk of waste toner falling out of the device.

(4) As shown in FIGS. 2 and 4, the collective conveying unit 64 is provided with the four first input cylinders 100 that protrude from the circumferential surface of the collective conveying tuber 98 at positions corresponding to the four drum-cleaning units 81. Each first input cylinder 100 has the inlet 104 for receiving waste toner collected by the corresponding drum-cleaning unit 81 therein.

With this construction, waste toner collected from the photosensitive drums 25 by the respective drum cleaning units 81 can be certainly consolidated in the collective conveying tube 98 through the respective inlets 104 of first input cylinders 100.

(5) As shown in FIGS. 2 and 4, the collective conveying unit 64 includes the collective conveying screw 99 disposed in the collective conveying tube 98 and configured to convey forward waste toner collected from the photosensitive drums 25 by the drum-cleaning units 81 and waste toner collected from the intermediate transfer belt 44 by the belt cleaning unit 144.

With this construction, the collective conveying tube 98 conveys forward waste toner collected from four photosensitive drums 25 and waste toner collected from the intermediate transfer belt 44. As a result, the waste toner can be certainly consolidated in the collective conveying tube 98.

(6) As shown in FIG. 3, the drum-cleaning units 81 are configured to convey waste toner collected from the corresponding photosensitive drums 25 leftward. This arrangement enables waste toner collected from the photosensitive drums 25 by the corresponding drum-cleaning units 81 to be reliably consolidated.

(7) As shown in FIG. 5, the belt-cleaning unit 144 is configured to convey waste toner collected from the intermediate transfer belt 44 leftward. Hence, this configuration can reliably consolidate waste toner collected from the intermediate transfer belt 44 by the belt-cleaning unit 144.

(8) As shown in FIGS. 1 and 3, each of the drum-cleaning units 81 includes a drum-cleaning blade 88 that collects waste toner from the corresponding photosensitive drum 25, and a drum-cleaning screw 89 that conveys waste toner collected from the corresponding photosensitive drum 25 by the drum-cleaning blade 88 leftward. Thus, the drum-cleaning blade 88 scrapes waste toner off the corresponding photosensitive drum 25, and the drum-cleaning screw 89 conveys this waste toner leftward. Hence, this construction can reliably consolidate waste toner collected from the photosensitive drums 25.

(9) As shown in FIGS. 1 and 5, the belt-cleaning unit 144 includes the belt-cleaning blade 146 that recovers waste toner from the intermediate transfer belt 44, and the belt-cleaning screw 148 that conveys the waste toner collected from the intermediate transfer belt 44 by the belt-cleaning blade 146 leftward. Thus, the belt-cleaning blade 146 scrapes waste toner off the intermediate transfer belt 44, while the belt-cleaning screw 148 conveys the waste toner leftward. Hence, this construction can reliably convey waste toner collected from the intermediate transfer belt 44 to the waste toner box 178.

(10) As shown in FIGS. 1 and 8, the belt-cleaning unit 144 is disposed rearward of the rearmost photosensitive drum 25. This arrangement can suppress contact between the cartridge-supporting body 16 and the belt-cleaning unit 144 when the cartridge-supporting body 16 is moved between the internal and the external positions.

(14) As shown in FIGS. 1 and 8, the waste toner box 178 is disposed forward of the rearmost photosensitive drum 25. Specifically, the waste toner box 178 is disposed near the cartridge-support-body access opening 120 in the front portion of the main casing 2. With this arrangement, the waste toner box 178 can be easily maintained.

(12) As shown in FIGS. 5 and 6, the waste toner box 178 can be detachably mounted in the main casing 2. Thus, the waste toner box 178 can easily be removed for maintenance when waste toner has accumulated therein.

Since the waste toner box 178 is detachably mounted in the main casing 2 and collects waste toner removed from all photosensitive drums 25 by the corresponding drum-cleaning units 81, there is less chance that the user will become soiled by waste toner on a portion other than the neighborhood of the waste toner box 178 when removing the waste toner box 178.

9. Second Embodiment

(1) Constructions of Printer According to Second Embodiment

Next, a second embodiment of the image forming apparatus will be described with reference to FIGS. 9 through 11, wherein like parts and components are designated with the same reference numerals to avoid duplicating description. Further, drawings in connection to the second embodiment are not sufficient unlike the drawings in connection to the first embodiment. However, several drawings for the first embodiment are also available for the second embodiment.

In the printer 1 according to the first embodiment described above, the process cartridges 21 provided with photosensitive drums 25 are detachably mountable in the support-body frame 63 of the cartridge-supporting body 16, as illustrated in FIGS. 4 and 8. When the process cartridges 21 are mounted in the support-body frame 63, the communication holes 94 of the corresponding drum-cleaning units 81 overlap the inlets 104 formed in the collective conveying unit 64, as shown in FIG. 3. Consequently, the drum-cleaning frames 87 of the four drum-cleaning units 81 are configured to communicate with the collective conveying tube 98 of the collective conveying unit 64.

Figure 9:
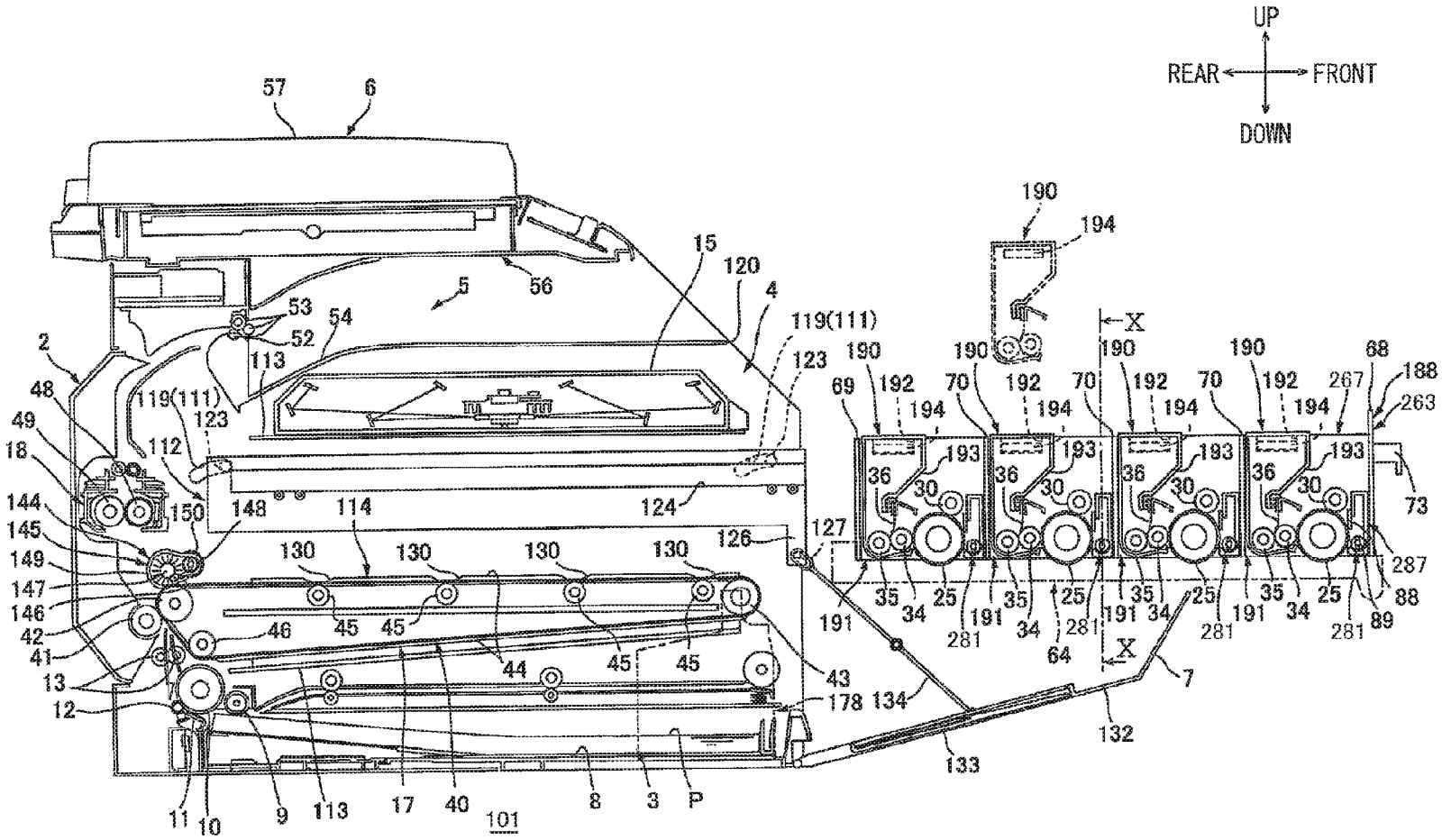
FIG. 9 is a cross-sectional view of a printer as an example of an image forming apparatus according to a second embodiment of the present invention and showing an external position of a drawer unit.

In a printer 101 according to the second embodiment, the cartridge-supporting body 16, the four process cartridges 21, and the drum-cleaning unit 81 are replaced with a drawer unit 188, four developing cartridges 190, and four drum-cleaning units 281, as shown in FIG. 9. That is, the support-body frame 63 is replaced with a cartridge-supporting body 216 in the printer 101.

Further, the developing cartridges 190 are not provided with the photosensitive drum 25, charging roller 30, and drum-cleaning unit 281. Rather, the drawer unit 188 is configured to support the four developing cartridges 190 in addition to a support-body frame 263, the four photosensitive drums 25, the four charging rollers 30, four drum-cleaning units 281, and a collective conveying unit 264.

(1-1) Structure of Drawer Unit

The cartridge-supporting body 216 has the same construction as that of the cartridge-supporting body 16 except that the support-body frame 63 and the collective conveying unit 64 are replaced with the support-body frame 263 and the collective conveying unit 264. As with the support-body frame 63 in the first embodiment described above, the support-body frame 263 includes a pair of side support-body walls 267, the front support-body wall 68, the rear support-body wall 69, and the three partitioning support-body walls 70. In the cartridge-supporting body 216, spaces in the support-body frame 263 surrounded by neighboring partitioning support-body walls 70 and the pair of side support-body walls 267 are defined as developing-cartridge accommodating sections 191. In addition, the space in the front end of the support-body frame 63 surrounded by the front support-body wall 68, the forwardmost partitioning support-body wall 70, and the pair of side support-body walls 267 is defined as a developing-cartridge accommodating section 191, and the space in the rear end of the support-body frame 263 surrounded by the rear support-body wall 69, the rearmost partitioning support-body wall 70, and the pair of side support-body walls 267 is defined as a developing-cartridge accommodating section 191. Hence, four developing-cartridge accommodating sections 191 are juxtaposed in the support-body frame 263 in the front-rear direction. The four developing cartridges 190 can be detachably mounted in corresponding developing-cartridge accommodating sections 191 formed in the support-body frame 263.

Figure 10:
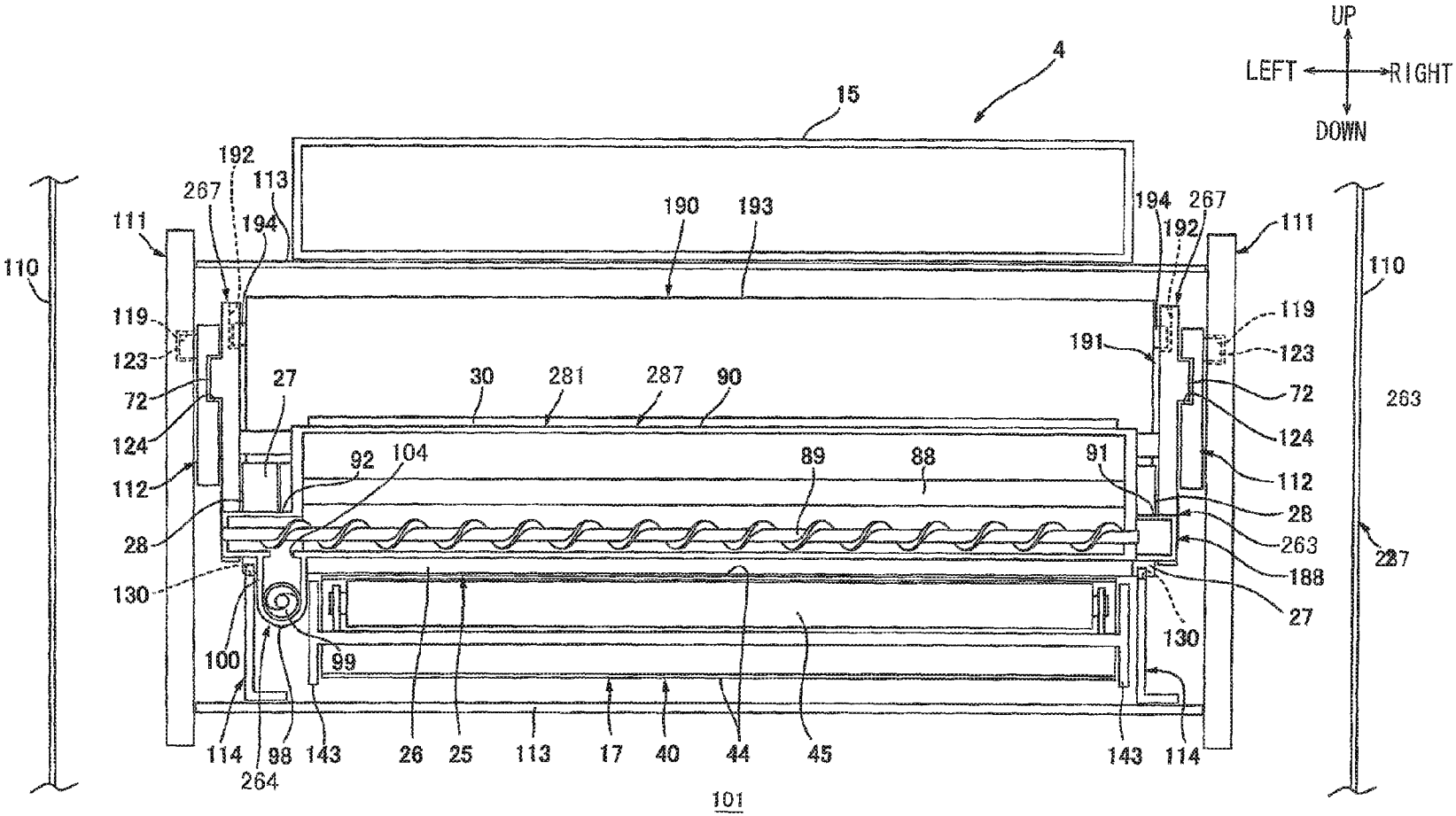
FIG. 10 is a cross-sectional view taken along a line X-X in FIG. 9 showing an assembled state of a developing cartridge with respect to a drawer unit.
Figure 11:
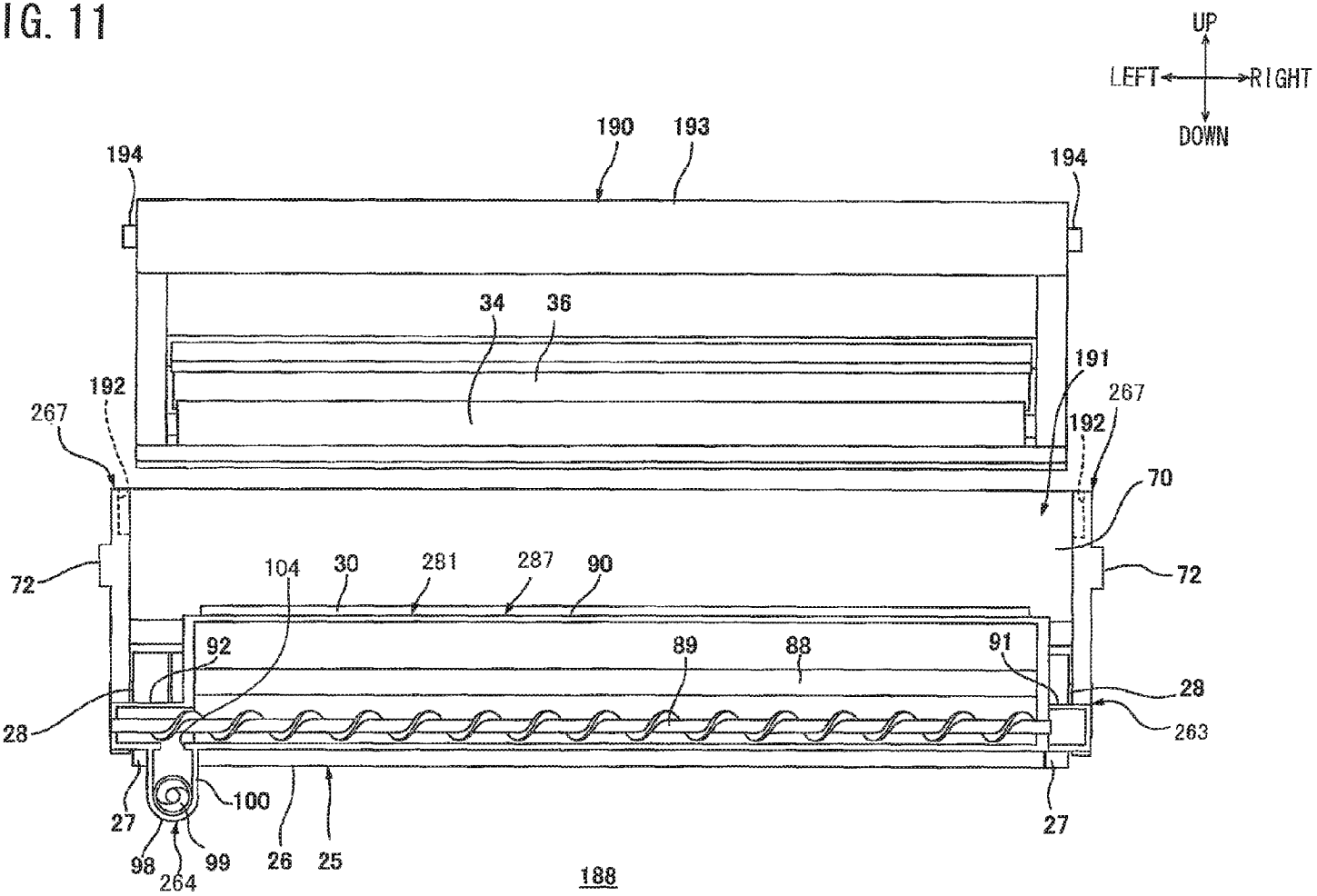
FIG. 11 is a cross-sectional view taken along the line X-X in FIG. 9 showing a disassembled state of the developing cartridge with respect to the drawer unit.

As shown in FIGS. 9 and 10, each of the side support-body walls 267 constituting the support-body frame 263 is provided with a receiving groove 192 for each of the four developing-cartridge accommodating sections 191. The receiving grooves 192 receive corresponding engaging protrusions 194 formed on developing frames 193 described later.

The receiving grooves 192 are recesses formed in the inner left-right surfaces of the corresponding side support-body walls 267 and are positioned in the rear portion of the corresponding developing-cartridge accommodating section 191. The receiving grooves 192 have a general squared U-shape in a plan view that is open on both the top and the inner left-right side. In other words, four receiving grooves 192 are formed in each of the side support-body walls 267 at intervals in the front-rear direction, as shown in FIG. 9.

The photosensitive drums 25 are respectively provided in the bottom ends of the corresponding developing-cartridge accommodating sections 191. As shown in FIGS. 10 and 11, the photosensitive drums 25 are rotatably supported in the support-body frame 263, with the left and right ends of the drum shafts 28 supported in the corresponding side support-body walls 267. Consequently, the four photosensitive drums 25 are arranged parallel to each other and are spaced at intervals in the front-rear direction, as shown in FIG. 9. Further, the photosensitive drums 25 are arranged such that the bottom surfaces of the drum bodies 26 and the bottom ends of the flanges 27 are lower than the bottom end of the support-body frame 263.

The charging rollers 30 are disposed on the upper front sides of the corresponding photosensitive drums 25. As shown in FIGS. 10 and 11, the charging rollers 30 are rotatably supported in the support-body frame 263, with their left and right ends supported in the corresponding side support-body walls 267.

As shown in FIG. 9, the drum-cleaning units 281 are disposed in the lower front region of the corresponding developing-cartridge accommodating sections 191 and are in front of the corresponding photosensitive drums 25. The drum-cleaning unit 281 has the same construction as that of the drum-cleaning unit 81 except that the drum-cleaning frame 87 is replaced with a drum-cleaning frame 287. As shown in FIGS. 10 and 11, the drum-cleaning units 281 are supported in the support-body frame 263 such that the right frame protrusion 91 of the drum-cleaning frame 287 is formed continuously with the right side support-body wall 267, and the left frame protrusion 92 of the drum-cleaning frame 287 is formed continuously with the left side support-body wall 267.

With the four drum-cleaning units 281 and the collective conveying unit 264 supported in the support-body frame 263 in this way, the left frame protrusions 92 of the drum-cleaning units 281 are connected to the corresponding input cylinders 200 of the collective conveying unit 264. Hence, the drum-cleaning frames 287 of the four drum-cleaning units 281 are connected and capable of communicating with the collective conveying tube 98 of the collective conveying unit 264.

(1-2) Detailed Description of the Developing Cartridges

As shown in FIG. 9, each developing cartridge 190 includes a developing frame 193 in addition to the developing roller 34, the supply roller 35, and the thickness-regulating blade 36 described above.

The developing frame 193 is configured to accommodate toner therein. As shown in FIGS. 9 and 11, the developing frame 193 has a box-like shape that is elongated in the left-right direction. An opening is formed in the front wall of the developing frame 193 at the bottom end thereof. The opening spans the entire left-right dimension of the developing frame 193 and penetrates the front wall in the front-rear direction. The developing frame 193 includes a pair of engaging protrusions 194 that are configured to engage in the corresponding receiving grooves 192 formed in the side support-body walls 267.

One of the engaging protrusions 194 is provided on each outer left-right surface of the corresponding left and right side walls constituting the developing frame 193. The engaging protrusions 194 are ridge-like members that are elongated in the front-rear direction and protrude outward in the left-right direction. The engaging protrusions 194 have a slightly smaller front-rear dimension than the receiving grooves 192.

The developing rollers 34 are disposed in the lower front region of the corresponding developing cartridges 190, such that their front and upper surfaces are exposed through the opening formed in the developing cartridges 190. The left and right ends of the developing rollers 34 are supported in the left and right side walls constituting the corresponding developing cartridges 190.

The supply rollers 35 are disposed in the lower rear region of the corresponding developing cartridges 190. The left and right ends of the supply rollers 35 are supported in the left and right side walls of the corresponding developing cartridges 190.

The thickness-regulating blades 36 are fixed to the upper peripheral edges defining the openings in the corresponding developing cartridges 190.

As shown in FIGS. 9 and 10, each of the developing cartridges 190 is accommodated in the corresponding developing-cartridge accommodating section 191 with the pair of engaging protrusions 194 provided on the developing frame 193 received in the corresponding pair of receiving grooves 192 formed in the support-body frame 263. In this way, the developing cartridges 190 can be detachably accommodated in the support-body frame 263.

The collective conveying unit 264 is configured to consolidate all waste toner and other deposited matter removed from the drum bodies 26 of the photosensitive drums 25 by the corresponding drum-cleaning units 281 in the collective conveying tube 98 and to convey this deposited matter together through the collective conveying tube 98.

(2) Operational Advantages of the Second Embodiment

As shown in FIG. 9, the printer 101 according to the second embodiment includes the main casing 2, the four developing cartridges 190, the drawer unit 188, the intermediate transfer belt 44, the belt-cleaning unit 144, and the waste toner box 178.

The four developing cartridges 190 are each configured to accommodate toner.

The drawer unit 188 is provided with the four photosensitive drums 25, and the four drum-cleaning units 281 that are provided to correspond to the four photosensitive drums 25 and are configured to collect waste toner from the photosensitive drums 25. The drawer unit 188 is also configured to support the four developing cartridges 190, while capable of being moved between the internal position inside the main casing 2 and the external position outside the main casing 2.

The intermediate transfer belt 44 is disposed so as to oppose the four photosensitive drums 25 when the drawer unit 188 supporting four developing cartridges 190 is in the internal position.

The belt-cleaning unit 144 is configured to collect waste toner from the surface of the intermediate transfer belt 44.

The waste toner box 178 is configured to accommodate waste toner collected from the photosensitive drums 25 by the corresponding drum-cleaning units 281, and waste toner collected from the intermediate transfer belt 44 by the belt-cleaning unit 144.

The drawer unit 188 is also provided with the collective conveying unit 64 that is configured to collectively convey, to the waste toner box 178, waste toner collected from the photosensitive drums 25 by the four drum-cleaning units 281 and waste toner collected from the intermediate transfer belt 44 by the belt cleaning unit 144.

This construction enables the printer 101 to consolidate all waste toner collected from the four photosensitive drums 25 by the corresponding drum-cleaning units 281 and waste toner collected from the intermediate transfer belt 44 by the belt-cleaning unit 144 into a single waste toner box 178.

Hence, this construction enables the printer 101 to be made more compact than a structure in which the receptacle for collecting waste toner from the photosensitive drums 25 is provided separately from a receptacle for collecting waste toner from the intermediate transfer belt 44.

Further, providing a single receptacle for collecting waste toner rather than a plurality of receptacles makes disposal of the waste toner easier.

The printer 101 according to the second embodiment can obtain the same operational advantages as the printer 1 according to the first embodiment described above.

While the invention has been described in detail with reference to the embodiments thereof, it would be apparent to those skilled in the art that various changes and modifications may be made therein without departing from the spirit of the invention.

The invention claimed is:

1. A drawer movable between an internal position inside a main frame of an image forming apparatus and an external position outside of the main frame, the drawer comprising:

a supporting portion configured to support a plurality of cartridges;

a first photosensitive drum;

a second photosensitive drum;

a first drum cleaner configured to collect waste toner on the first photosensitive drum;

a second drum cleaner configured to collect waste toner on the second photosensitive drum; and a collective conveyer configured to convey collectively waste toner collected by the first drum cleaner and the second drum cleaner, the collective conveyer including:

a first connecting portion configured to connect with and disconnect from a belt-cleaning unit that is provided in the main frame and is configured to clean a belt, the first connecting portion connecting with the belt-cleaning unit when the drawer is positioned at the internal position, the first connecting portion disconnecting from the belt-cleaning unit when the drawer is positioned at the external position, the first connecting portion having a belt waste toner receiving opening through which the waste toner collected by the belt-cleaning unit passes; and a second connecting portion configured to connect with and disconnect from a waste toner cartridge provided in the main frame, the second connecting portion connecting with the waste toner cartridge when the drawer is positioned at the internal position, the second connecting portion disconnecting from the waste toner cartridge when the drawer is positioned at the external position, the second connecting portion having a collective toner ejecting opening through which the waste toner is delivered to the waste toner cartridge.

2. The drawer as claimed in claim 1, wherein the first photosensitive drum and the second photosensitive drum are arrayed in an array direction; and wherein the collective conveyer is configured to convey the waste toner collected by the first drum cleaner and the second drum cleaner in the array direction.

3. The drawer as claimed in claim 2, wherein the collective conveyer comprises a collective conveying tube allowing passage of waste toner therethrough and extending in the array direction, the collective conveying tube having:

the belt waste toner receiving opening;

the collective toner ejecting opening;

a first inlet through which the waste toner collected by the first drum cleaner passes; and a second inlet through which the waste toner collected by the second drum cleaner passes.

4. The drawer as claimed in claim 3, wherein the collective conveyer further comprises a collective conveying member disposed in the collective conveying tube and configured to convey the waste toner collected by the first drum cleaner and the second drum cleaner and waste toner collected by the belt-cleaning unit in the array direction.

5. The drawer as claimed in claim 4, wherein the collective conveying member comprises a screw feeder.

6. The drawer as claimed in claim 3, wherein the collective conveyer includes:

a first cylindrical part protruding from an outer peripheral surface of the collective conveying tube, the first cylindrical part having the first inlet; and a second cylindrical part protruding from the outer peripheral surface of the collective conveying tube, the second cylindrical part having the second inlet.

7. The drawer as claimed in claim 1, wherein each of the first photosensitive drum and the second photosensitive drum has an axis defining an axial direction; and wherein the first drum cleaner and the second drum cleaner are configured to convey the waste toner collected by the first photosensitive drum and the waste toner collected by the second photosensitive drum in the axial direction, respectively.

8. The drawer as claimed in claim 1, wherein each of the first photosensitive drum and the second photosensitive drum has an axis defining an axial direction; and wherein each of the first drum cleaner and the second drum cleaner comprises:

a drum cleaning member configured to collect the waste toner on a corresponding one of the first photosensitive drum and the second photosensitive drum; and a conveying member configured to convey the waste toner collected by the drum cleaning member in the axial direction.

9. The drawer as claimed in claim 8, wherein the drum cleaning member comprises a drum cleaning blade.

10. The drawer as claimed in claim 8, wherein the conveying member comprises a screw feeder.

11. An image forming apparatus comprising:

a casing;

a first process cartridge including a first photosensitive drum and a first drum-cleaning unit configured to collect waste toner on the first photosensitive drum;

a second process cartridge including a second photosensitive drum and a second drum-cleaning unit configured to collect waste toner on the second photosensitive drum, the first process cartridge and the second process cartridge being arrayed in an array direction;

a cartridge-supporting body configured to support the first process cartridge and the second process cartridge, the cartridge-supporting body being movable between an internal position inside the casing and an external position outside the casing;

a waste toner cartridge configured to accommodate both the waste toner collected from the first photosensitive drum by the first drum-cleaning unit and the waste toner collected from the second photosensitive drum by the second drum-cleaning unit;

a first wall arranged inside the casing and having an L-shape as viewed from the array direction, the first wall having a first recess for receiving one end portion of the first process cartridge and a second recess for receiving one end portion of the second process cartridge;

a second wall arranged inside the casing and having an L-shape as viewed from the array direction, the second wall having a third recess for receiving another end portion of the first process cartridge and a fourth recess for receiving another end portion of the second process cartridge, the first process cartridge being supported by the first recess and the third recess when the cartridge-supporting body supporting the first and second process cartridges is located at the internal position, the first process cartridge being apart from both the first recess and the third recess when the cartridge-supporting body supporting the first and second process cartridges is located at the external position, the second process cartridge being supported by the second recess and the fourth recess when the cartridge-supporting body supporting the first and second process cartridges is located at the internal position, the second process cartridge being apart from both the second recess and the fourth recess when the cartridge-supporting body supporting the first and second process cartridges is located at the external position; and a conveying unit configured to convey the waste toner collected by the first drum-cleaning unit and the waste toner collected by the second drum-cleaning unit, the conveying unit being provided to the cartridge-supporting body and being disposed between the first wall and the second wall when the cartridge-supporting body is located at the internal position.

12. The The image forming apparatus according to claim 11, further comprising a belt;

wherein, when the cartridge-supporting body supporting the first and second process cartridges is located at the internal position, the cartridge-supporting body is movable between a contact position where both the first photosensitive drum and the second photosensitive drum come in contact with the belt and a separated position where the first photosensitive drum and the second photosensitive drum are apart from the belt; and wherein the conveying unit is configured to convey the waste toner collected by the first drum-cleaning unit and the waste toner collected by the second drum-cleaning unit when the cartridge-supporting body supporting the first and second process cartridges is located at the contact position.

13. The image forming apparatus according to claim 12, wherein the first drum-cleaning unit has a first communication hole and the second drum-cleaning unit has a second communication hole; and wherein the conveying unit has a first inlet aligned with the first communication hole and a second inlet aligned with the second communication hole when the cartridge-supporting body supporting the first and second process cartridges is located at the contact position.

14. The image forming apparatus according to claim 13, wherein the conveying unit includes:

a collective conveying tube;

a first input cylinder protruding from the collective conveying tube, the first input cylinder having the first inlet for receiving waste toner discharged through the first communication hole of the first drum-cleaning unit; and a second input cylinder protruding from the collective conveying tube, the second input cylinder having the second inlet for receiving waste toner discharged through the second communication hole of the second drum-cleaning unit.

15. The image forming apparatus according to claim 12, further comprising a belt-cleaning unit configured to collect waste toner on the belt, wherein the waste toner cartridge is further configured to accommodate the waste toner collected by the belt-cleaning unit; and wherein the conveying unit is further configured to convey the waste toner collected by the belt-cleaning unit to the waste toner cartridge.

16. An image forming apparatus comprising:

a casing;

a first developing cartridge configured to accommodate toner therein;

a second developing cartridge configured to accommodate toner therein, the first developing cartridge and the second developing cartridge being arrayed in an array direction;

a drawer unit including:

a first photosensitive drum;

a first drum-cleaning unit configured to collect waste toner on the first photosensitive drum;

a second photosensitive drum; and a second drum-cleaning unit configured to collect waste toner on the second photosensitive drum;

a waste toner cartridge configured to accommodate both the waste toner collected from the first photosensitive drum by the first drum-cleaning unit and the waste toner collected from the second photosensitive drum by the second drum-cleaning unit;

a first wall arranged inside the casing and having an L-shape as viewed from the array direction, the first wall having a first recess for receiving one end portion of the first photosensitive drum and a second recess for receiving one end portion of the second photosensitive drum;

a second wall arranged inside the casing and having an L-shape as viewed from the array direction, the second wall having a third recess for receiving another end portion of the first photosensitive drum and a fourth recess for receiving another end portion of the second photosensitive drum, the first photosensitive drum being configured to be supported by the first recess and the third recess, the second photosensitive drum being configured to be supported by the second recess and the fourth recess; and a conveying unit configured to convey the waste toner collected by the first drum-cleaning unit and the waste toner collected by the second drum-cleaning unit, the conveying unit being provided to drawer unit and being disposed between the first wall and the second wall when the drawer unit is located at an internal position inside the casing.

17. The image forming apparatus according to claim 16, further comprising a belt, wherein the drawer unit is movable between the internal position inside the casing and an external position outside the casing;

wherein, when the drawer unit is located at the internal position, the drawer unit is movable between a contact position where both the first photosensitive drum and the second photosensitive drum come in contact with the belt and a separated position where the first photosensitive drum and the second photosensitive drum are apart from the belt; and wherein the conveying unit is configured to convey the waste toner collected by the first drum-cleaning unit and the waste toner collected by the second drum-cleaning unit when the drawer unit is located at the contact position.

18. The image forming apparatus according to claim 17, wherein the first drum-cleaning unit has a first communication hole and the second drum-cleaning unit has a second communication hole; and wherein the conveying unit has a first inlet aligned with the first communication hole and a second inlet aligned with the second communication hole when the drawer unit is located at the contact position.

19. The image forming apparatus according to claim 18, wherein the conveying unit includes:

a collective conveying tube;

a first input cylinder protruding from the collective conveying tube, the first input cylinder having the first inlet for receiving waste toner discharged through the first communication hole of the first drum-cleaning unit; and a second input cylinder protruding from the collective conveying tube, the second input cylinder having the second inlet for receiving waste toner discharged through the second communication hole of the second drum-cleaning unit.

20. The image forming apparatus according to claim 17, further comprising a belt-cleaning unit configured to collect waste toner on the belt, wherein the waste toner cartridge is further configured to accommodate the waste toner collected by the belt-cleaning unit; and wherein the conveying unit is further configured to convey the waste toner collected by the belt-cleaning unit to the waste toner cartridge.

* * * * *